US010166780B2

(12) United States Patent
Shinoda et al.

(10) Patent No.: US 10,166,780 B2
(45) Date of Patent: Jan. 1, 2019

(54) LIQUID ACCOMMODATING BODY, LIQUID FILLING METHOD, AND LIQUID EJECTING APPARATUS

(71) Applicant: SEIKO EPSON CORPORATION, Tokyo (JP)

(72) Inventors: Tomoki Shinoda, Shiojiri (JP); Takeshi Iwamuro, Matsumoto (JP); Takanori Seki, Suwa (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/670,869

(22) Filed: Aug. 7, 2017

(65) Prior Publication Data

US 2018/0056662 A1 Mar. 1, 2018

(30) Foreign Application Priority Data

Aug. 24, 2016 (JP) ..... 2016-163865
Sep. 15, 2016 (JP) ..... 2016-180255

(51) Int. Cl.
*B41J 2/175* (2006.01)
*B41J 2/14* (2006.01)
(Continued)

(52) U.S. Cl.
CPC ..... *B41J 2/17596* (2013.01); *B41J 2/14048* (2013.01); *B41J 2/1652* (2013.01);
(Continued)

(58) Field of Classification Search
CPC .... B41J 2/175; B41J 2/17509; B41J 2/17513; B41J 2/1752; B41J 2/17523; B41J 2/17553; B41J 2/17556
See application file for complete search history.

(56) References Cited

U.S. PATENT DOCUMENTS 5,886,721 A 3/1999 Fujii et al.
2003/0007048 A1* 1/2003 Otsuka ..... B41J 2/17506 347/89
(Continued)

FOREIGN PATENT DOCUMENTS

JP 08-197743 A 8/1996
JP 08-207298 8/1996
(Continued)

*Primary Examiner* — Anh T. N. Vo
(74) *Attorney, Agent, or Firm* — Workman Nydegger

(57) ABSTRACT

A liquid accommodating body includes a liquid accommodating chamber that accommodates liquid, a pouring port through which the liquid is poured into the liquid accommodating chamber, a visual recognition portion through which a surface of liquid accommodated in the liquid accommodating chamber is visually recognized and which is provided on a side wall forming the liquid accommodating chamber, a partition wall that partitions the liquid accommodating chamber into a pouring port side liquid accommodating chamber into which the liquid is poured through the pouring port and a visual recognition portion side liquid accommodating chamber including the visual recognition portion in a direction intersecting a gravity direction, and a liquid communication portion which is provided between the partition wall and a bottom wall forming the liquid accommodating chamber and through which the pouring port side liquid accommodating chamber and the visual recognition portion side liquid accommodating chamber communicate with each other.

19 Claims, 15 Drawing Sheets

(51) Int. Cl.
*B41J 29/13* (2006.01)
*B41J 29/02* (2006.01)
*B41J 2/165* (2006.01)

(52) U.S. Cl.
CPC ..... *B41J 2/16508* (2013.01); *B41J 2/175* (2013.01); *B41J 2/1752* (2013.01); *B41J 2/17506* (2013.01); *B41J 2/17509* (2013.01); *B41J 2/17513* (2013.01); *B41J 2/17553* (2013.01); *B41J 2/17556* (2013.01); *B41J 2/17563* (2013.01); *B41J 29/02* (2013.01); *B41J 29/13* (2013.01); *B41J 2002/17516* (2013.01); *B41J 2002/17569* (2013.01)

(56) References Cited

U.S. PATENT DOCUMENTS

2003/0067520 A1* 4/2003 Inoue ..... B41J 2/17503 347/86
2004/0141023 A1 7/2004 Nakamura
2004/0189756 A1 9/2004 Ikezaki
2006/0082621 A1 4/2006 Tsukada et al.
2006/0176346 A1 8/2006 Momose
2012/0038719 A1 2/2012 Shimizu
2014/0043408 A1* 2/2014 Kudo ..... B41J 2/175 347/86
2014/0063148 A1 3/2014 Iwamuro et al.
2015/0352853 A1* 12/2015 Kudo ..... B41J 2/175 347/86
2015/0367648 A1* 12/2015 Kimura ..... B41J 2/17509 347/86

FOREIGN PATENT DOCUMENTS

JP 2003-170607 A 6/2003
JP 2004-188410 A 7/2004
JP 2004-291297 A 10/2004
JP 2005-144708 A 6/2005
JP 2006-082070 A 3/2006
JP 2006-137181 A 6/2006
JP 2006-198846 A 8/2006
JP 2012-111146 A 6/2012
JP 2012-121232 A 6/2012
JP 2012-236335 A 12/2012
JP 2014-046626 A 3/2014
JP 2015-120356 A 7/2015
JP 2016-000507 A 1/2016

* cited by examiner

LIQUID ACCOMMODATING BODY, LIQUID FILLING METHOD, AND LIQUID EJECTING APPARATUS

BACKGROUND

1. Technical Field

The present invention relates to a liquid accommodating body and a liquid ejecting apparatus including the liquid accommodating body.

2. Related Art

There is a liquid ejecting apparatus in which liquid accommodated in a liquid accommodating body is supplied to a liquid ejecting unit, which ejects liquid via a nozzle, via a tube or the like and the supplied liquid is ejected onto a paper sheet or the like, which is an example of a medium, from the liquid ejecting unit so that an image or the like is printed on the paper sheet. The liquid accommodating body provided in such a liquid ejecting apparatus may be configured such that liquid can be poured (poured for replenishment) into the liquid accommodating body via a pouring port, with which the liquid accommodating body is provided, in a case where the amount of accommodated liquid decreases due to the supply of liquid to the liquid ejecting unit.

Meanwhile, when liquid is poured into the liquid accommodating body having a configuration as described above via the pouring port, bubbles (air bubbles) may be generated from the poured liquid due to falling of the liquid and the generated bubbles may spill out via the pouring port. Therefore, in the related art, there is a technique of lowering a possibility that bubbles, which are generated due to liquid being poured, spill out via the pouring port (liquid pouring port) in the liquid accommodating body (liquid accommodating container) (refer to JP-A-2015-120356).

In addition, when a user uses such a liquid ejecting apparatus for the first time, a liquid supply flow path is in a state of being filled with nothing (state of being filled with gas). Therefore, in the liquid ejecting apparatus, a liquid filling operation (initial filling operation) of filling the liquid supply flow path, which is in a state of being filled with nothing, with liquid is performed. For example, a filling operation of filling the liquid supply flow path with liquid by depressurizing a space in the vicinity of a nozzle which is sealed with a cap in the liquid ejecting unit and causing the nozzle to suction air in the liquid supply flow path and liquid from the liquid accommodating body is performed (refer to JP-A-2006-137181).

However, in the liquid accommodating body described in JP-A-2015-120356, a space portion is provided above the pouring port (is provided closer to counter-gravity direction side than pouring port is) and the generated bubbles are retained in the space portion. Therefore, it is possible to lower a possibility that the generated bubbles spill out via the pouring port. However, a possibility that the generated bubbles are present below the pouring port in the liquid accommodating body is not lowered. As a result, there is a problem that it is difficult to visually recognize a surface of poured liquid at an upper limit denoting portion (upper limit line), which is provided in the vicinity of the pouring port and denotes a position which a liquid surface reaches when the amount of liquid poured (poured for replenishment) and accommodated reaches the upper limit, due to the bubbles present below the pouring port.

Note that, a liquid accommodating body that includes a liquid accommodating chamber which can accommodate liquid, a pouring port through which liquid can be poured to the liquid accommodating chamber, and a visual recognition portion through which a surface of liquid accommodated in the liquid accommodating chamber can be visually recognized, has the substantially same problem as that described above.

In addition, the liquid ejecting apparatus described in JP-A-2006-137181 has a problem that air is likely to remain in the liquid supply flow path after the filling operation since it is necessary to discharge a mixture of liquid and air in the liquid supply flow path (particularly, supply pipe) from a connection end portion connected to the liquid accommodating body to the outside via a pressure adjustment mechanism and the liquid ejecting unit in the filling operation.

SUMMARY

An advantage of some aspects of the invention is to provide a liquid accommodating body into which liquid can be poured with ease and a liquid ejecting apparatus that includes the liquid accommodating body.

In addition, an advantage of some aspects of the invention is to provide a liquid filling method and a liquid ejecting apparatus with which it is possible to efficiently fill a liquid supply flow path, which connects a liquid accommodating body to a liquid ejecting unit, with liquid.

Hereinafter, means of the invention and operation effects thereof will be described.

According to an aspect of the invention, there is provided a liquid accommodating body including a liquid accommodating chamber that accommodates liquid, a pouring port through which the liquid is poured into the liquid accommodating chamber, a visual recognition portion through which a surface of the liquid accommodated in the liquid accommodating chamber is visually recognized and which is provided on a side wall forming the liquid accommodating chamber, a partition wall that partitions the liquid accommodating chamber into a pouring port side liquid accommodating chamber into which the liquid is poured through the pouring port and a visual recognition portion side liquid accommodating chamber including the visual recognition portion in a direction intersecting a gravity direction, and a liquid communication portion which is provided between the partition wall and a bottom wall forming the liquid accommodating chamber and through which the pouring port side liquid accommodating chamber and the visual recognition portion side liquid accommodating chamber communicate with each other.

According to this configuration, it is possible to suppress inflow of bubbles, which are generated at the time when liquid is poured, into the visual recognition portion side liquid accommodating chamber from the pouring port side liquid accommodating chamber. Therefore, the visibility of the surface of liquid through the visual recognition portion is improved.

In the liquid accommodating body, a liquid repellent treatment is preferably performed on at least an inner wall of the visual recognition portion on the side wall of the liquid accommodating chamber, the inner wall being on the liquid accommodating chamber side.

According to this configuration, the visibility of the surface of liquid through the visual recognition portion is improved.

The liquid accommodating body preferably further includes an atmosphere communication portion through which at least the visual recognition portion side liquid accommodating chamber out of the visual recognition portion side liquid accommodating chamber and the pouring port side liquid accommodating chamber communicates with the atmosphere.

According to this configuration, the position of the surface of liquid which is visually recognized through the visual recognition portion is a position corresponding to the amount of accommodated liquid. Therefore, the liquid accommodating body is suitable as a liquid accommodating body into which liquid can be accommodated through a pouring operation.

In the liquid accommodating body, the liquid communication portion is preferably positioned closer to a gravity direction side than a falling region on the bottom wall in the pouring port side liquid accommodating chamber is, the falling region being a region onto which the liquid poured through the pouring port falls.

According to this configuration, it is possible to suppress inflow of bubbles, which are generated when the liquid poured into the pouring port side liquid accommodating chamber falls onto the falling region, into the visual recognition portion side liquid accommodating chamber from the pouring port side liquid accommodating chamber. Therefore, the visibility of the surface of liquid through the visual recognition portion is improved.

In the liquid accommodating body, the visual recognition portion is preferably provided with a lower limit denoting portion that denotes a position which a liquid surface reaches when the amount of liquid accommodated in the liquid accommodating chamber reaches the lower limit, and the liquid communication portion is preferably positioned closer to a gravity direction side than the lower limit denoting portion is.

According to this configuration, the position of the surface of liquid in the pouring port side liquid accommodating chamber being lower than that of the liquid communication portion is suppressed. Therefore, it is possible to decrease a possibility that the bubbles flow into the visual recognition portion side liquid accommodating chamber from the pouring port side liquid accommodating chamber and the visibility of the surface of liquid through the visual recognition portion is improved.

In the liquid accommodating body, the visual recognition portion is preferably provided with an upper limit denoting portion that denotes a position which a liquid surface reaches when the amount of liquid accommodated in the liquid accommodating chamber reaches the upper limit, and the liquid accommodating chamber is preferably provided with an upper communication portion which is positioned closer to the counter-gravity direction side than the upper limit denoting portion is and through which the pouring port side liquid accommodating chamber and the visual recognition portion side liquid accommodating chamber communicate with each other.

According to this configuration, the position of the surface of liquid in the visual recognition portion side liquid accommodating chamber being different from the position of the surface of liquid in the pouring port side liquid accommodating chamber is suppressed. Therefore, the positional accuracy of the surface of liquid at the visual recognition portion increases.

According to another aspect of the invention, there is provided a liquid ejecting apparatus including a liquid ejecting unit that ejects liquid through a nozzle, and the above-described liquid accommodating body that accommodates the liquid to be ejected by the liquid ejecting unit.

According to this configuration, it is possible to suppress inflow of bubbles, which are generated at the time when liquid is poured, into the visual recognition portion side liquid accommodating chamber from the pouring port side liquid accommodating chamber. Therefore, the visibility of the surface of liquid through the visual recognition portion is improved.

According to still another aspect of the invention, there is provided a liquid filling method of filling a liquid ejecting apparatus with liquid, the liquid ejecting apparatus including a liquid ejecting unit that ejects liquid and a liquid supply flow path that connects a liquid accommodating body and a liquid ejecting unit such that the liquid accommodated in the liquid accommodating body is supplied to the liquid ejecting unit and that includes an intermediate storage body connection portion that is positioned between the liquid accommodating body and the liquid ejecting unit and that is connected to an intermediate storage body including an intermediate storage portion in which the liquid is stored, the method including causing the liquid to flow from the intermediate storage body connection portion into an upstream side liquid supply flow path, which is a portion of the liquid supply flow path positioned on the upstream side of the intermediate storage body connection portion, so that the upstream side liquid supply flow path is filled with the liquid.

According to still another aspect of the invention, there is provided a liquid ejecting apparatus including a liquid ejecting unit that ejects liquid, a liquid accommodating body that includes a liquid accommodating portion which accommodates the liquid, a pouring port through which the liquid is poured into the liquid accommodating portion from the outside, and an atmosphere communication hole through which the liquid accommodating portion communicates with the atmosphere, a liquid supply flow path that connects the liquid accommodating body and the liquid ejecting unit such that the liquid accommodated in the liquid accommodating body is supplied to the liquid ejecting unit and that includes an intermediate storage body connection portion that is positioned between the liquid accommodating body and the liquid ejecting unit and that is connected to an intermediate storage body including an intermediate storage portion in which the liquid is stored, and a liquid flow mechanism that causes the liquid stored in the intermediate storage portion of the intermediate storage body connected to the intermediate storage body connection portion to flow into an upstream side liquid supply flow path which is a portion of the liquid supply flow path positioned on the upstream side of the intermediate storage body connection portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Liquid Ejecting Apparatus in First Embodiment

Hereinafter, a liquid ejecting apparatus will be described with reference to drawings. Note that, a liquid ejecting apparatus in a first embodiment is, for example, an ink jet printer that ejects ink, which is an example of liquid, onto a paper sheet, which is an example of a medium, to perform printing and is configured as a multifunction machine that includes an image reading device such as a scanner. In addition, the printer is a so-called serial printer in which printing is performed with a liquid ejecting head, which functions as a liquid ejecting unit that ejects ink from a nozzle, being moved in a main scanning direction (direction X) that intersects a transportation direction of a paper sheet. Hereinafter, a direction (direction Y) parallel to the transportation direction of a paper sheet will be also referred to as a "front/rear direction", the main scanning direction (direction X) in which the liquid ejecting head moves at the time of printing will be also referred to as a "transverse direction", a gravity direction, which is one of vertical directions, will be also referred to as a "downward direction", and a counter-gravity direction, which is the other of the vertical directions, will be also referred to as an "upward direction".

Figure 1:
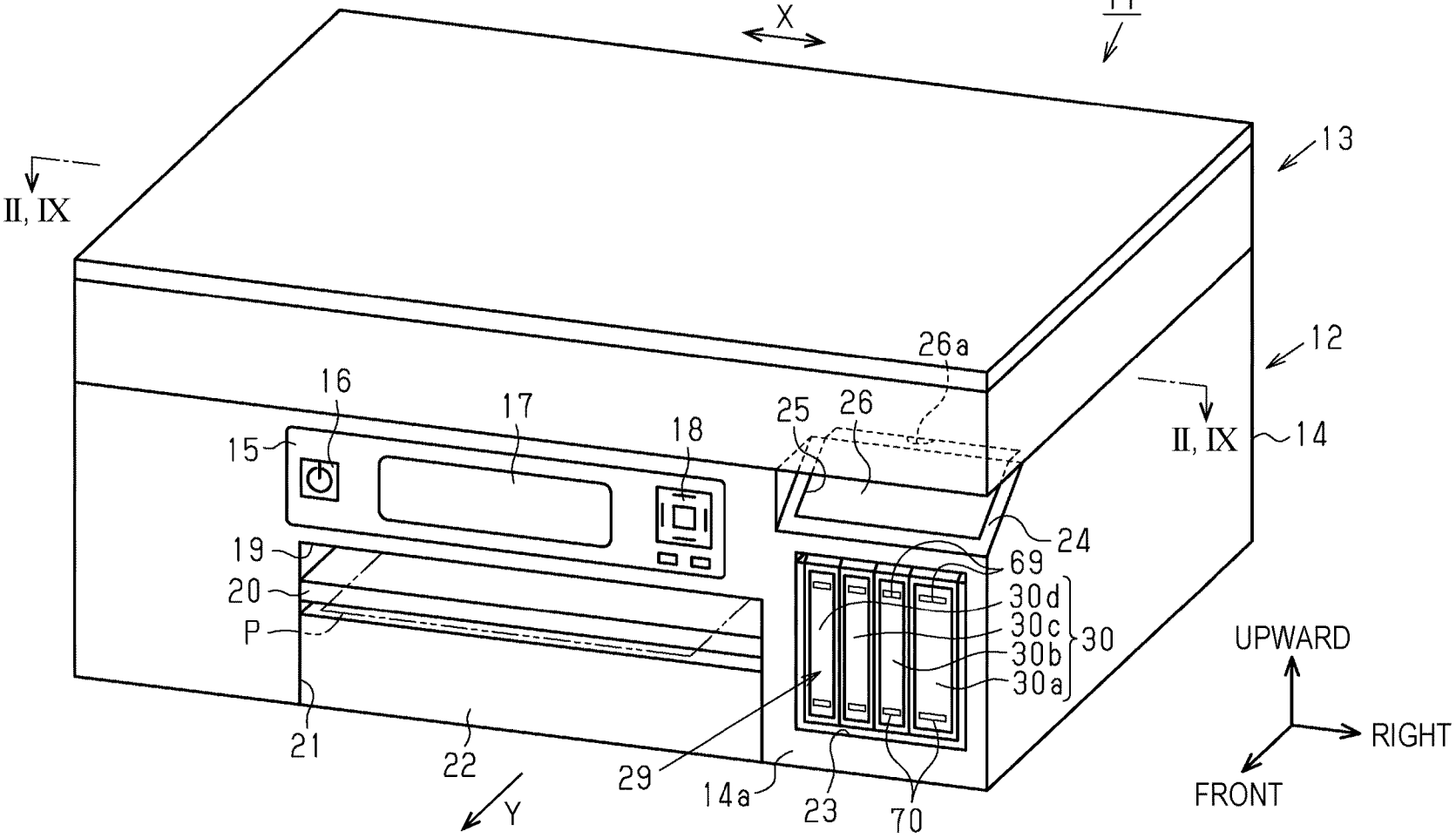
FIG. 1 is a perspective view of a liquid ejecting apparatus according to a first embodiment and a second embodiment which is a multifunction machine including a liquid accommodating body.

As illustrated in FIG. 1, a multifunction machine 11 includes a liquid ejecting apparatus 12 that has a printing function and an image reading device 13 that has a reading function. The liquid ejecting apparatus 12 includes a housing 14 having a rectangular parallelopiped shape and the image reading device 13 is disposed on the housing 14. The shapes of the housing 14 of the liquid ejecting apparatus 12 and the image reading device 13 are substantially the same as each other when seen from above.

An operation unit 15 for performing various operations of the multifunction machine 11 is provided on the substantially central position in the transverse direction on an upper portion of a front surface of the housing 14 of the liquid ejecting apparatus 12. The operation unit 15 includes, for example, a power button 16, a touch panel type liquid crystal display surface 17, an operation button 18, and the like and has a rectangular shape which is long in a lateral direction as seen from a front surface side which is a side close to a user.

In addition, a rectangular discharging hole 19, through which a paper sheet P on which printing has been performed in the housing 14 of the liquid ejecting apparatus 12 is discharged toward the front side, opens on the front surface of the housing 14 of the liquid ejecting apparatus 12 while being disposed at a position below the operation unit 15. A rectangular plate-shaped discharging tray 20 that supports the paper sheet P (medium) discharged through the discharging hole 19 is provided below the discharging hole 19 to be slidable in the front/rear direction which is a discharging direction.

A cassette mounting portion 21 is provided below the discharging tray 20 on the front surface of the housing 14 and a paper feeding cassette 22, into which a plurality of paper sheets P used for printing can be accommodated in a state of being stacked, is mounted in the cassette mounting portion 21 such that the paper feeding cassette 22 can be inserted and extracted in the front/rear direction. Note that, the paper feeding cassette 22 is formed to have such a size that the positions of a front end of the paper feeding cassette 22 and the front surface of the housing 14 in the front/rear direction become substantially the same when the paper feeding cassette 22 is mounted in the cassette mounting portion 21.

In addition, as illustrated in FIG. 1, a rectangular transparent window 23, which is formed of, for example, glass or transparent resin material, is provided on a position on a front surface side wall 14*a* of the housing 14 of the liquid ejecting apparatus 12 which is closer to an end portion in the transverse direction than the cassette mounting portion 21 is (in FIG. 1, closer to right end portion as seen from front). In addition, in the housing 14 of the liquid ejecting apparatus 12, a liquid supply unit 29, of which the dimensions in a vertical direction and the transverse direction are substantially the same as the dimensions in the vertical direction and the transverse direction of the transparent window 23, is accommodated while being disposed at a position behind the transparent window 23. The liquid supply unit 29 is a structure that is configured to include a plurality of (four in first embodiment) liquid accommodating bodies 30 (30*a* to 30*d*) so that the liquid accommodating bodies can be handled in a collective manner and ink can be poured into each of the liquid accommodating bodies 30*a* to 30*d* as described below.

Figure 2:
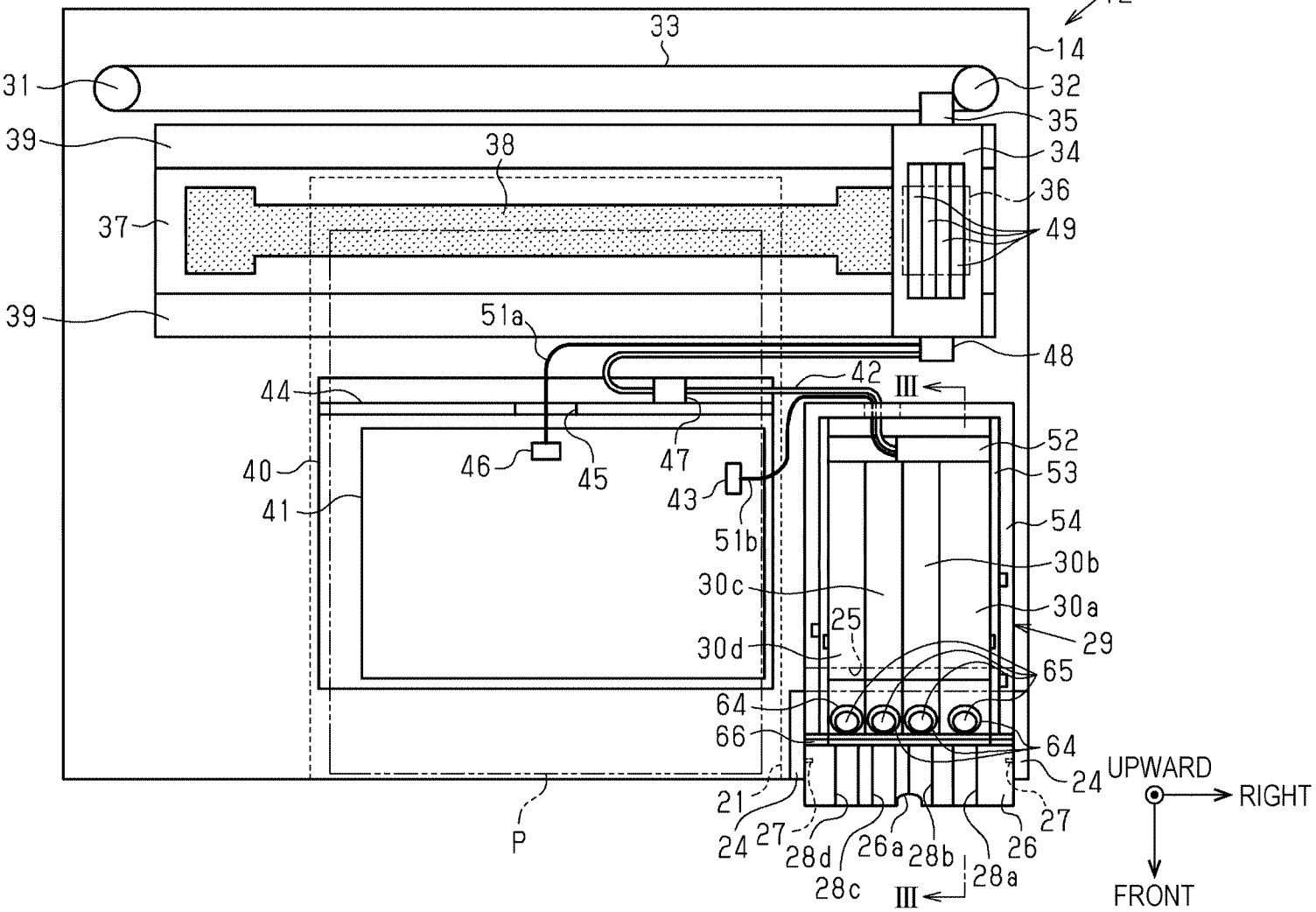
FIG. 2 is a plane view illustrating an internal structure of the liquid ejecting apparatus according to the first embodiment which is taken along line II-II in FIG. 1.

In addition, as illustrated in FIGS. 1 and 2, an inclined portion 24 that inclines frontward and obliquely downward is formed on the front surface side wall 14*a* of the housing 14 of the liquid ejecting apparatus 12 while being positioned above the transparent window 23. An area above the inclined portion 24 is covered by a portion of the image reading device 13 supported on the housing 14 which is close to the front surface and is close to a right end portion.

In addition, the inclined portion 24 is provided with a rectangular opening portion 25 and the opening portion 25 is provided with a covering member 26 that can be displaced between a closing position (refer to FIG. 3) at which the opening portion 25 is closed and an opening position (refer to FIG. 5) at which the opening portion 25 is opened. That is, each of a pair of right and left rotation shafts 27 which extends in the transverse direction is provided at a position which is close to a lower end of the inclined portion 24 of the housing 14 and faces the inner space of the opening portion 25 and a base end portion of the covering member 26 is rotatably supported by the rotation shafts 27. Accordingly, the covering member 26 is opened and closed when the covering member 26 moves between the closing position and the opening position while rotating about the rotation shafts 27.

Note that, in FIG. 2, which is a plane view, the liquid supply unit 29 accommodated in the housing 14 is illustrated with a solid line with the housing 14 above the liquid supply unit 29 being omitted and the opening portion 25, which is formed in the inclined portion 24 of the omitted housing 14, is illustrated with a two-dot chain line. In addition, in the plane view, the covering member 26 in a state of being positioned at the opening position is illustrated with a solid line.

A finger-hooking portion 26*a*, into which a user puts the tips of fingers when displacing the covering member 26 from the closing position to the opening position, is formed on the substantially central portion in the transverse direction of a front edge of the covering member 26 through a cutting process. Furthermore, as illustrated in FIG. 2, a plurality of (four in first embodiment) recessed grooves 28 (28*a* to 28*d*) each of which extends in the front/rear direction are formed on the rear surface of the covering member 26 which is a surface facing upwards when the covering member 26 is in the opening position. Incidentally, the recessed grooves 28 (28*a* to 28*d*) are positioned on the same lines as the liquid accommodating bodies 30 (30*a* to 30*d*), which are arranged behind the transparent window 23 and are arranged in the transverse direction to be parallel to each other, in the front/rear direction, respectively.

As illustrated in FIG. 2, a driven pulley 31 is provided at a position that is close to a rear surface and a left end in the housing 14 of the liquid ejecting apparatus 12 and a driving pulley 32, which can be rotated by a motor (not shown), is provided at a position that is close to the rear surface and a right end in the housing 14. An endless timing belt 33 is wound around the pulleys 31 and 32 and a portion of the timing belt 33 is connected to a connection portion 35 which is provided on a rear portion of a carriage 34. Note that, a liquid ejecting head 36, which is an example of a liquid ejecting unit that ejects inks of a plurality of (four in first embodiment) colors onto the paper sheet P from a nozzle (not shown) to perform printing, is installed on a lower surface of the carriage 34.

In addition, a supporting table 37 having a rectangular parallelopiped shape, which is long in the transverse direction intersecting the front/rear direction which is the transportation direction of the paper sheet P, is disposed in front of the timing belt 33 in the housing 14 of the liquid ejecting apparatus 12. The supporting table 37 is a table that supports a lower surface of the paper sheet P when the paper sheet P is transported in the transportation direction at the time of printing and a porous ink absorbing member 38 extending over a substantially rectangular area that is long in the transverse direction is exposed on a surface of the supporting table 37 which faces the liquid ejecting head 36. In addition, a pair of front and rear rails 39 that movably supports the carriage 34 and extends in the transverse direction is provided in front of and behind the supporting table 37. Therefore, if the driving pulley 32 is rotated with the motor being driven, a driving force thereof is transmitted to the connection portion 35 via the timing belt 33 and the carriage 34 reciprocates in the transverse direction while being guided by the pair of front and rear rails 39.

In addition, in the housing 14 of the liquid ejecting apparatus 12, a supporting frame portion 40 which is rectangular as seen in plane view is provided in front of the front rail 39 and a circuit board 41 which functions as a controller including a CPU or the like is supported on the supporting frame portion 40. A plurality of connectors 43 and 46 (only two connectors are illustrated in first embodiment for purpose of exemplification) are fixed to an upper portion of the circuit board 41. In addition, a vertical guide wall 44 which extends in the transverse direction is formed on a portion of the supporting frame portion 40 which is close to a rear edge extending along a long side on a rear portion side of the circuit board 41.

A notched recess 45 is formed on the substantially central portion of the guide wall 44 in the transverse direction. In addition, a fixing member 47 that fixes an intermediate portion of each liquid supply tube 42 is provided on a portion of the rear surface of the guide wall 44 which is closer to the right end portion than the notched recess 45 is and is close to the carriage 34. One end of each liquid supply tube 42 is connected to the liquid supply unit 29 and each liquid supply tube 42 is flexible. A portion of the each liquid supply tube 42, which is closer to the other end of each liquid supply tube 42 than the fixing member 47 is, is folded back after extending along the rear surface of the guide wall 44 and the other end is connected to each sub tank (intermediate storage body) 49 installed on the carriage 34 via a connection portion 48 that is provided on the front portion of the carriage 34.

Liquid supplied via the liquid supply tubes 42 is temporarily stored in the sub tank 49 and the liquid is supplied to the liquid ejecting head 36. The liquid supply tubes 42 may be connected to the liquid ejecting head 36 via an adapter (not shown) without installing the sub tank 49 on the carriage 34. Note that, the number of the plurality of (four in first embodiment) liquid supply tubes 42 routed is the same as the number of the plurality of (four in first embodiment) liquid accommodating bodies 30*a* to 30*d* included in the liquid supply unit 29. However, in FIG. 2 or the like, only one liquid supply tube 42 is illustrated and three liquid supply tubes 42 among the four liquid supply tubes 42 are omitted for the purpose of simplification. In addition, the four liquid supply tubes may be configured as a quadruple tube that is obtained by integrally forming the four liquid supply tubes with each other.

In addition, a signal wire 51*a*, of which one end is connected to the liquid ejecting head 36 or the like, leads out of the connection portion 48 of the carriage 34, and the other end of the signal wire 51*a* is connected to the circuit board 41 via the connector 46 with the signal wire 51*a* passing through the notched recess 45 after extending along the rear surface of the guide wall 44 which is close to the carriage 34. In addition, one end of a signal wire 51*b*, of which the other end is connected to the liquid supply unit 29, is connected to the other connector 43 on the circuit board 41.

Next, the liquid supply unit 29 which supplies ink to the liquid ejecting head 36 will be described.

As illustrated in FIG. 2, the liquid supply unit 29 is configured to include the plurality of liquid accommodating bodies 30*a* to 30*d*, a flow path forming member 52 in which an ink flow path connected to the liquid accommodating bodies 30*a* to 30*d* is formed, and a setting member 53 in which the plurality of liquid accommodating bodies 30*a* to 30*d* are set along with the flow path forming member 52 in a state where the liquid accommodating bodies 30*a* to 30*d* are arranged such that the liquid accommodating bodies 30*a* to 30*d* overlap each other as seen from a thickness direction thereof. In addition, the liquid supply unit 29 is retained while being positioned with respect to a holding member 54, which is fixed to a position in the housing 14 which is close to the front surface and the right end portion, in a state where the plurality of liquid accommodating bodies 30*a* to 30*d* and the flow path forming member 52 are set together in the setting member 53.

A liquid accommodating body 30*a* that accommodates black ink, a liquid accommodating body 30*b* that accommodates cyan ink, a liquid accommodating body 30*c* that accommodates magenta ink, and a liquid accommodating body 30*d* that accommodates yellow ink constitute the plurality of liquid accommodating bodies 30*a* to 30*d*. The four liquid accommodating bodies 30*a* to 30*d* are set in the setting member 53 in a state where the longitudinal direction thereof is parallel to the front/rear direction, which is a depth direction from the front surface of the housing 14, and the liquid accommodating bodies 30*a* to 30*d* are arranged in the transverse direction, which is the main scanning direction in which the liquid ejecting head 36 moves at a time of printing on the paper sheet P. When the liquid accommodating bodies 30*a* to 30*d* are set, the liquid accommodating body 30*a* for black ink of which the capacity is larger than that of the other three liquid accommodating bodies 30*b* to 30*d*, is set such that the liquid accommodating body 30*a* is positioned closest to the right end in the transverse direction in a case where the liquid accommodating bodies are installed in the housing 14 of the liquid ejecting apparatus 12, as illustrated in FIG. 2. Note that, all of the liquid accommodating bodies may have the same size.

Each of the plurality of liquid accommodating bodies 30*a* to 30*d* is an ink tank having an approximately rectangular parallelopiped shape. The thickness direction of each ink tank is parallel to the transverse direction which is parallel to an arrangement direction in a state where the liquid accommodating bodies 30*a* to 30*d* are disposed in parallel in the housing 14 via the setting member 53 or the like. The lateral direction of each ink tank is parallel to a height direction which is parallel to the vertical direction. The longitudinal direction of each ink tank is parallel to the front/rear direction of the housing 14 which is parallel to the transportation direction of the paper sheet P. Configurations of the liquid accommodating bodies 30*a* to 30*d* are the same as each other except for dimensions in the thickness direction thereof.

Liquid Accommodating Body in First Embodiment

Next, the configurations of the liquid accommodating bodies 30 in the first embodiment which are included in the liquid ejecting apparatus 12 will be described. Here, the description will be made by using a configuration of the liquid accommodating body 30*a* in which black ink is accommodated as a representative of the configurations of the liquid accommodating bodies 30.

Figure 3:
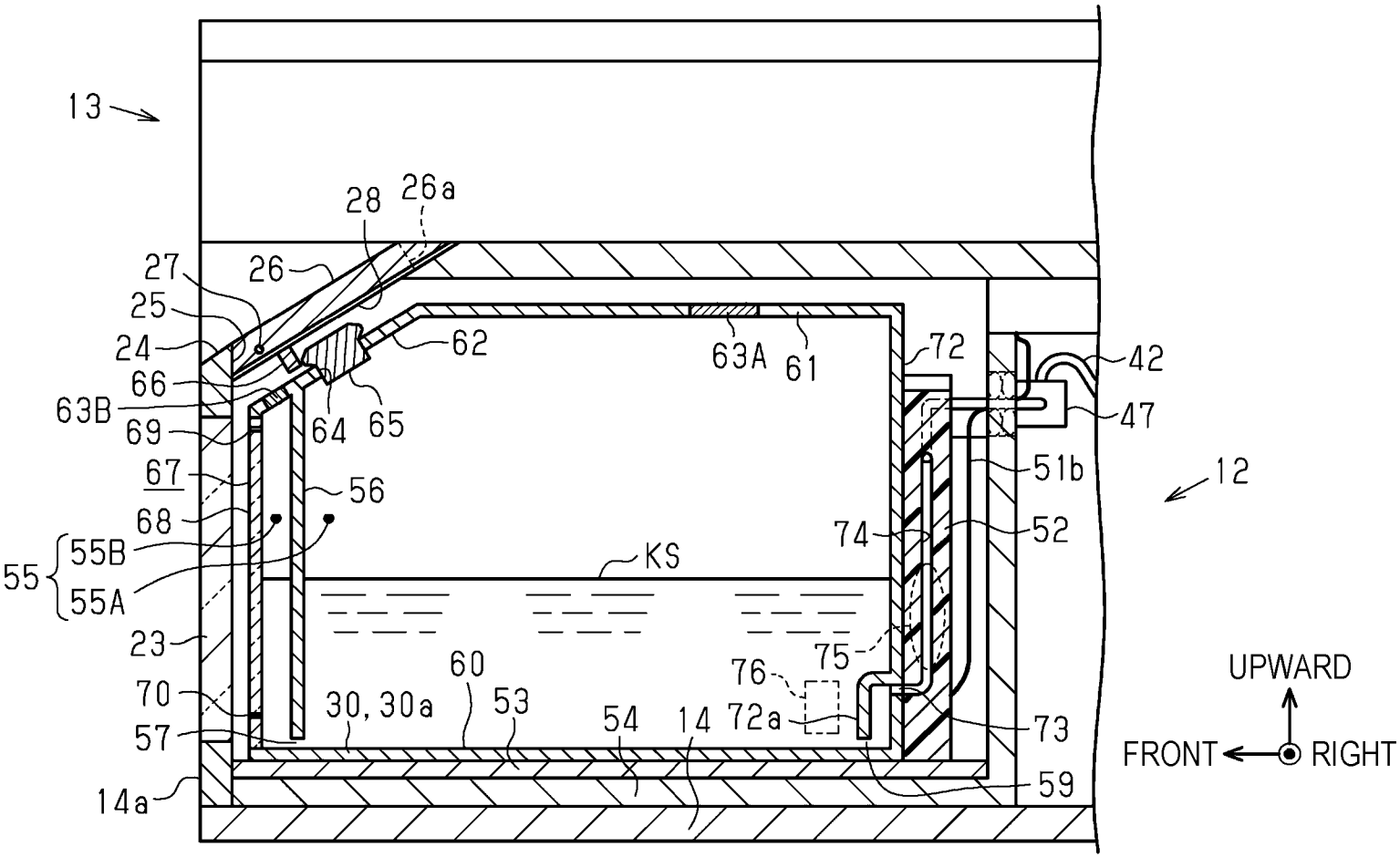
FIG. 3 is a partial sectional view taken along line III-III in FIG. 2.

As illustrated in FIG. 3, a liquid accommodating chamber 55 that is formed by a top wall, side walls, and a bottom wall is provided in each liquid accommodating body 30 in the first embodiment. That is, when the liquid accommodating bodies 30 are disposed in parallel in the housing 14 via the setting member 53 or the like, each top wall forms a wall surface of the liquid accommodating chamber 55 which is on the counter-gravity direction side in the vertical direction and each bottom wall forms a wall surface of the liquid accommodating chamber 55 which is on the gravity direction side in the vertical direction. In addition, the side walls form four wall surfaces of the liquid accommodating chamber 55 including front and rear wall surfaces and right and left wall surfaces in a horizontal direction such that the rear wall surfaces and right and left wall surfaces connect the top wall and the bottom wall.

The top wall is configured to include a rectangular horizontal wall portion 61 extending in the longitudinal direction and an inclined surface wall portion 62 that is connected to the front end of the horizontal wall portion 61 and inclines frontward and obliquely downward. The horizontal wall portion 61 is provided with an atmosphere communication portion 63A through which the liquid accommodating chamber 55 communicates with the atmosphere. Note that, the atmosphere communication portion 63A is configured to have, for example, a narrow flow path structure called a meandering groove which is an elongated groove formed to meander or is formed of a moisture-permeable waterproof material or the like that allows passage of gases such as air and restricts passage of liquid.

In a state where the liquid accommodating body 30 is set in the housing 14 via the setting member 53 or the like, the inclined surface wall portion 62 is positioned above the transparent window 23 formed in the front surface side wall 14*a* of the housing 14 and inclines such that the height thereof in the vertical direction decreases toward the front surface side wall 14*a* of the housing 14. In addition, a pouring port 64 through which ink from the outside can be poured into the liquid accommodating chamber 55 is formed in the inclined surface wall portion 62. Note that, the pouring port 64 is capped by a plug 65 formed of rubber or the like in a usual state (refer to FIG. 2).

Furthermore, the inclined surface wall portion 62 is provided with an atmosphere communication portion 63B that is closer to the front surface side wall 14*a* of the housing 14 than the pouring port 64 is and through which the liquid accommodating chamber 55 communicates with the atmosphere. As with the atmosphere communication portion 63A, the atmosphere communication portion 63B is configured to have, for example, a narrow flow path structure called a meandering groove which is an elongated groove formed to meander or is formed of a moisture-permeable waterproof material or the like that allows passage of gases such as air and restricts passage of liquid.

Note that, as illustrated in FIG. 3, in a case where the liquid accommodating body 30 is disposed in the housing 14, the inclined surface wall portion 62 of the liquid accommodating body 30 is positioned close to the rear surface of the inclined portion 24 which is formed in an upper portion of the front surface side wall 14*a* of the housing 14. In addition, the pouring port 64 formed in the inclined surface wall portion 62 of the liquid accommodating body 30 is hidden by the covering member 26 and is not exposed to the outside in a case where the covering member 26 provided in the opening portion 25 of the inclined portion 24 is in the closing position at which the covering member 26 closes the opening portion 25. On the other hand, the pouring port 64 formed in the inclined surface wall portion 62 of the liquid accommodating body 30 is not hidden by the covering member 26 and is exposed to the outside via the opening portion 25 in a case where the covering member 26 is in the opening position at which the opening portion 25 is opened. That is, the covering member 26 can be displaced between the opening position at which the pouring port 64 is exposed to the outside and the closing position at which the pouring port 64 is not exposed to the outside.

In addition, in the housing 14, a rod-shaped locking member 66, which extends in the transverse direction that is parallel to the rotation shafts 27, is provided at a position behind the covering member 26 in the closing position as an example of a locking mechanism for locking the covering member 26 in a state where the covering member 26 is displaced from the closing position to the opening position. That is, the locking member 66 is provided to extend in the transverse direction in a region through which the base end portion of the covering member 26 passes when the covering member 26 rotates about the rotation shafts 27. Therefore, when the covering member 26 is displaced from the closing position to the opening position, the locking member 66 locks the base end portion of the covering member 26 from the front side in a rotation direction so that the covering member 26 is restricted from further rotating in an opening direction from the opening position.

In addition, as illustrated in FIG. 3, a front wall portion 67, which is a front side wall of the liquid accommodating chamber 55, is provided with a visual recognition portion 68 through which a surface KS of ink in the liquid accommodating chamber 55 can be visually recognized and which is formed of transparent resin or the like. The visual recognition portion 68 is provided with an upper limit denoting portion 69 that denotes a position which a liquid surface reaches when the amount of liquid poured and accommodated in the liquid accommodating chamber 55 (poured amount) reaches the upper limit and a lower limit denoting portion 70 that denotes a position which a liquid surface reaches when the amount of liquid accommodated in the liquid accommodating chamber 55 (residual amount) reaches the lower limit. The visual recognition portion 68 is a wall portion that faces the front surface side wall 14*a* of the housing 14, in which the transparent window 23 is formed, in the front/rear direction and thus it is possible for a user to visually recognize the visual recognition portion 68 through the transparent window 23.

The liquid accommodating body 30 in the first embodiment is provided with the liquid accommodating chamber 55 which is partitioned (divided) into two accommodating chambers by a partition wall 56. That is, as illustrated in FIG. 3, the liquid accommodating chamber 55 is partitioned into a pouring port side liquid accommodating chamber 55A and a visual recognition portion side liquid accommodating chamber 55B in a direction intersecting the gravity direction by the flat plate-shaped partition wall 56 which extends in the vertical direction. Ink is poured into the pouring port side liquid accommodating chamber 55A through the pouring port 64 and the visual recognition portion side liquid accommodating chamber 55B includes the visual recognition portion 68.

An upper end of the partition wall 56 is connected to the inclined surface wall portion 62 at a position between the pouring port 64 and the atmosphere communication portion 63B. Accordingly, the pouring port side liquid accommodating chamber 55A communicates with the atmosphere through the atmosphere communication portion 63A and the visual recognition portion side liquid accommodating chamber 55B communicates with the atmosphere through the atmosphere communication portion 63B.

A lower end of the partition wall 56 extends up to such a position that a gap having a predetermined dimension is provided between the lower end and a bottom wall 60, which is a wall surface in the gravity direction of the liquid accommodating chamber 55. In other words, a gap, through which the pouring port side liquid accommodating chamber 55A and the visual recognition portion side liquid accommodating chamber 55B communicate with each other, is provided between the partition wall 56 and the bottom wall 60 that forms the liquid accommodating chamber 55 as a liquid communication portion 57. In the first embodiment, the liquid communication portion 57 is positioned closer to the gravity direction side than the lower limit denoting portion 70 is.

In addition, a liquid supply port 73, through which ink in the liquid accommodating chamber 55 (pouring port side liquid accommodating chamber 55A) is supplied to the outside, is formed in the vicinity of a lower end of a rear wall portion 72 which is a rear side wall of the liquid accommodating chamber 55 of the liquid accommodating body 30. In addition, on the rear wall portion 72, an L-shaped bent wall 72*a*, which forms a gap flow path 59 between the liquid accommodating chamber 55 and the bottom wall 60 and forms a flow path connecting the gap flow path 59 and the liquid supply port 73, is formed to protrude toward the liquid accommodating chamber 55 side.

Furthermore, the flow path forming member 52 is bonded to the rear wall portion 72 of the liquid accommodating body 30 such that ink supplied to the outside through the liquid supply port 73 is supplied to the liquid ejecting head 36. The flow path forming member 52 is a plate-shaped member formed of resin material or the like and has a predetermined thickness. In the flow path forming member 52, a flow path 74, through which ink supplied through the liquid supply port 73 of the liquid accommodating body 30 flows toward the liquid supply tube 42, is formed. Furthermore, in the flow path forming member 52, a pump 75 which is configured of a diaphragm or the like is provided in the middle of the flow path 74 as illustrated with a broken line in FIG. 3 and when the pump 75 is driven, ink is supplied in a direction from the liquid accommodating bodies 30*a* to 30*d* to the liquid ejecting head 36.

In addition, as illustrated with a broken line in FIG. 3, a residual amount detecting unit 76 for detecting the amount of ink remaining in the liquid accommodating chamber 55 is provided in the liquid accommodating body 30 as necessary. The residual amount detecting unit 76 is configured of a photo interrupter or the like that includes a light emitting element and a light receiving element and the residual amount detecting unit 76 is provided in each liquid accommodating body 30. When a detection signal indicating that the amount of ink remaining in the liquid accommodating chamber 55 is in a near-end state (ink is about to run out) is transmitted from the residual amount detecting unit 76 to the circuit board 41 via the signal wire 51*b*, a message that demands the pouring of ink is displayed on the liquid crystal display surface 17 of the operation unit 15 on the front surface of the housing 14.

Here, an example of the configuration of the liquid accommodating body 30 in the first embodiment will be described.

Figure 4:
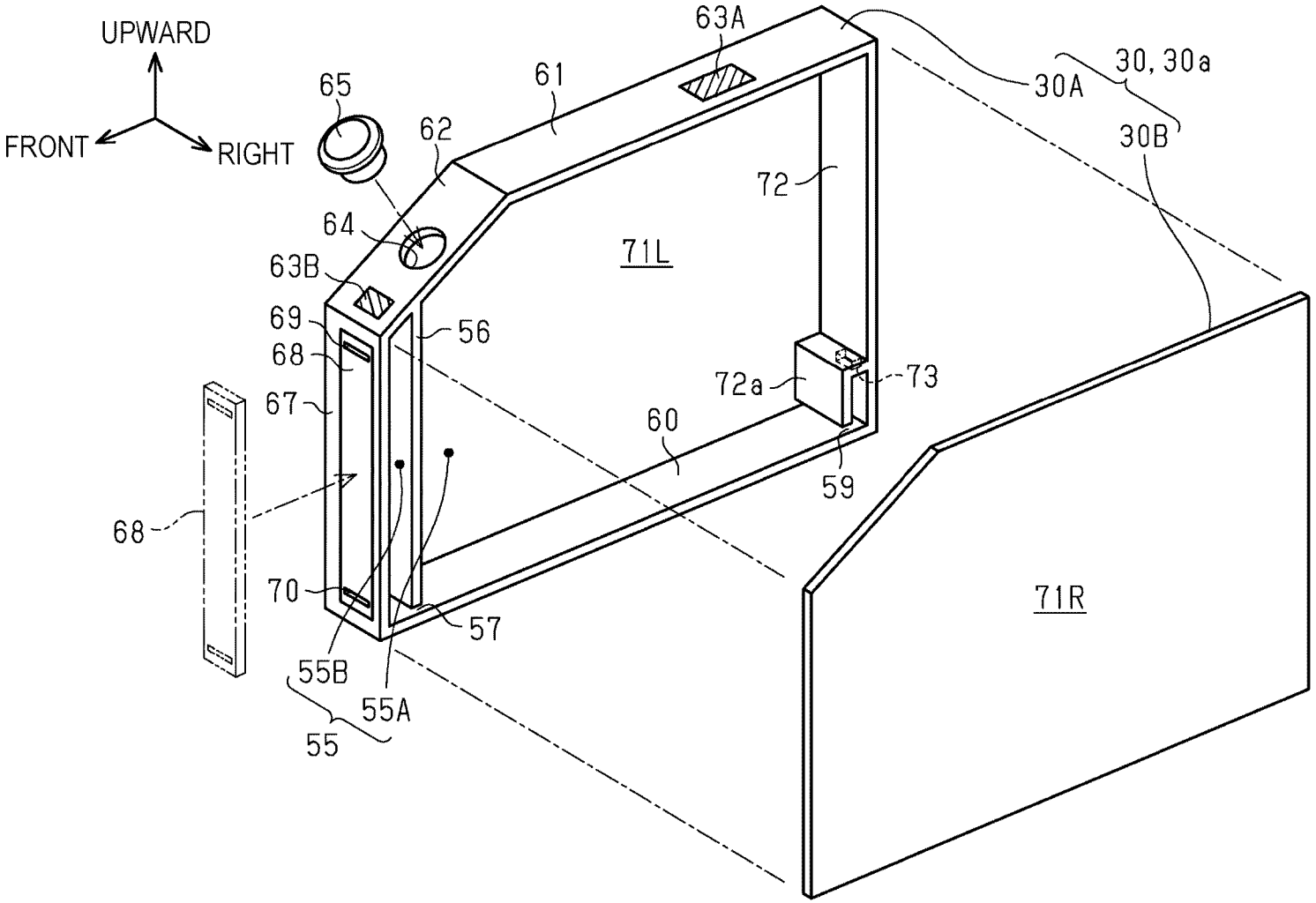
FIG. 4 is a perspective view illustrating a structure of a liquid accommodating body according to a first embodiment in the liquid ejecting apparatus according to the first embodiment.

As illustrated in FIG. 4, the liquid accommodating body 30 in the first embodiment is formed by bonding (or welding) a flat plate-shaped (or sheet-shaped) accommodating body lid portion 30B that has the substantially same shape as an opening of an accommodating body main body 30A, which is a box-shaped container provided with an opening on the left side thereof, to the accommodating body main body 30A such that the accommodating body lid portion 30B closes the opening of the accommodating body main body 30A.

Specifically, the accommodating body main body 30A is a box-shaped container that is formed by the horizontal wall portion 61 and the inclined surface wall portion 62 which are the top walls, the front wall portion 67 and the rear wall portion 72 which are the front and rear side walls of the liquid accommodating chamber 55, the bottom wall 60, and a left wall portion 71L which is a left side wall of the liquid accommodating chamber 55. The accommodating body main body 30A is provided with an opening on the left side thereof. In the box-shaped container, each of the partition wall 56 and the bent wall 72*a* is formed as a flat plate-shaped rib protruding from the left wall portion 71L.

When the accommodating body lid portion 30B is bonded to a right end (end surface) of each of the horizontal wall portion 61, the inclined surface wall portion 62, the front wall portion 67, the rear wall portion 72, the bottom wall 60, the partition wall 56, and the bent wall 72*a*, the liquid accommodating body 30 is formed and the inner space of the box-shaped container of the accommodating body main body 30A is formed as the liquid accommodating chamber 55. Therefore, the accommodating body lid portion 30B functions as a right wall portion 71R which is a right side wall of the liquid accommodating chamber 55. In addition, when the liquid accommodating chamber 55 is formed, the liquid accommodating chamber 55 is partitioned into the pouring port side liquid accommodating chamber 55A and the visual recognition portion side liquid accommodating chamber 55B by the partition wall 56 in the front/rear direction (horizontal direction) intersecting the vertical direction (gravity direction).

The visual recognition portion 68 is formed of transparent resin or translucent resin and is formed into a flat plate-like shape such that the surface KS of ink can be visually recognized through the visual recognition portion 68. The visual recognition portion 68 is fitted into a rectangular opening provided in the front wall portion 67 of the liquid accommodating body 30 (accommodating body main body 30A) with the peripheral portion of the visual recognition portion 68 bonded (or welded) to the opening. Accordingly, the visual recognition portion 68 forms a portion of the front wall portion 67 which is a side wall of the liquid accommodating chamber 55. Note that, the upper limit denoting portion 69 and the lower limit denoting portion 70 are provided by forming a recess or a protrusion on a plate surface of the visual recognition portion 68 or printing a line on the plate surface.

In addition, in the first embodiment, a liquid repellent treatment is performed on the inner wall of the visual recognition portion 68, which is a wall surface on the liquid accommodating chamber 55 (visual recognition portion side liquid accommodating chamber 55B) side, through application of a fluorine compound, a silicon compound, or the like such that the inner wall has an ink repellent property. Note that, the liquid repellent treatment here includes forming a member, which functions as the visual recognition portion 68, by using a material having an ink repellent property.

Next, the operation of the liquid accommodating body 30 configured as described above will be described below.

When a user recognizes that ink is supplied from the liquid accommodating body 30 (liquid accommodating chamber 55) of the liquid ejecting apparatus 12 and the position of the surface KS of ink at the visual recognition portion 68 is close to the lower limit denoting portion 70, the user performs an ink pouring operation with respect to the liquid accommodating body 30. Alternatively, when the user recognizes that the amount of ink remaining in the liquid accommodating chamber 55 of the liquid accommodating body 30 is in the near-end state through a notification message on the liquid crystal display surface 17 based on the result of detection performed by the residual amount detecting unit 76, the user performs the ink pouring operation with respect to the liquid accommodating body 30. Here, the operation of the liquid accommodating body 30 will be described by using a case where ink is poured into one liquid accommodating body 30 (liquid accommodating body 30*a*), of which the capacity is larger than that of the other three liquid accommodating bodies 30*b* to 30*d* of the four liquid accommodating bodies 30 (30*a* to 30*d*) and which is the rightmost liquid accommodating body when seen from the front surface side, as an example.

Figure 5:
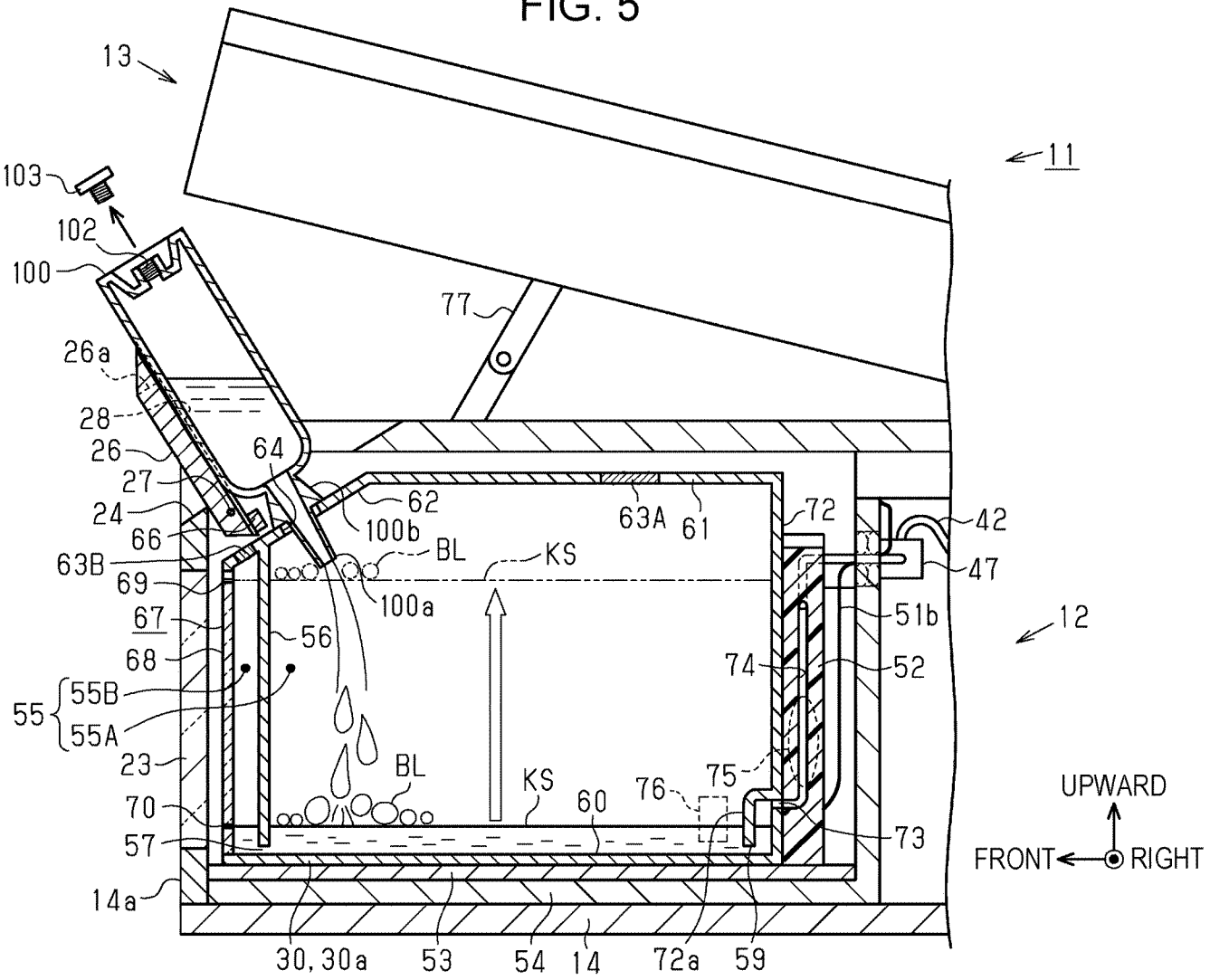
FIG. 5 is a partial sectional view illustrating a state where liquid is poured into the liquid accommodating body according to the first embodiment in the liquid ejecting apparatus according to the first embodiment.

As illustrated in FIG. 5, when performing the ink pouring operation, first, the user inclines the image reading device 13 supported on the upper surface of the housing 14 with a hinge (not shown) provided in the rear portion of the housing 14 as a fulcrum in such a manner that the front end of the image reading device 13 is lifted up. Thereafter, the front-lifted inclined state of the image reading device 13 is maintained by a link member 77 functioning as a supporter. As a result, an area above the inclined portion 24 that is provided with the covering member 26 is widely opened in the housing 14. Accordingly, the user opens the covering member 26 by putting fingers into the finger-hooking portion 26*a* of the covering member 26 in the closing position and pulling the covering member 26 toward the user side. Then, in a state where the covering member 26 has been rotated and displaced to the opening position as illustrated in FIG. 5, the plug 65 is removed from the pouring port 64 so that the pouring port 64 is opened and ink is poured into the liquid accommodating chamber 55 through the pouring port 64 in an opened state.

At this time, the base end portion of the covering member 26 in the opening position is locked by the locking member 66 and is restricted from further rotating in the opening direction so that the covering member 26 is stably held to the opening position. Next, in a state where the covering member 26 is in the opening position, the user mounts a liquid bottle 100, which is an example of a liquid pouring member storing ink to be poured, on the rear surface (surface facing obliquely upwards in FIG. 5) of the covering member 26.

Note that, for example, a body portion of the liquid bottle 100 in the first embodiment has a cylindrical shape and a tip end portion of the liquid bottle 100 is formed as an elongated spout portion 100*a* which extends along the central axis of the body portion. In addition, in a case where the spout portion 100*a* is inserted into the pouring port 64 of the liquid accommodating body 30 (30*a*), a circumferential surface of the body portion of the liquid bottle 100 is engaged with the recessed groove 28 (28*a*) and a rib-shaped stopper portion 100*b*, which is formed around the spout portion 100*a*, abuts onto the circumferential edge of the pouring port 64 of the inclined surface wall portion 62 of the liquid accommodating body 30 (30*a*). As a result, as illustrated in FIG. 5, even when the liquid bottle 100 is not held by a hand of the user, a state where the spout portion 100*a* is inserted in the pouring port 64 of the liquid accommodating body 30 (30*a*) is maintained.

Meanwhile, an air introduction portion 102 through which air can be introduced into the liquid bottle 100 is formed in a base end portion of the liquid bottle 100 which is opposite the spout portion 100*a* (that is, bottom portion of liquid bottle 100). In the first embodiment, the air introduction portion 102 is configured of a female screw hole, for example. In addition, in a usual situation, a lid member 103 that can air-tightly close the air introduction portion 102 is mounted in the air introduction portion 102. Incidentally, as illustrated in FIG. 5, when pouring ink into the liquid accommodating chamber 55, the user operates the lid member 103 such that the air-tightly closed air introduction portion 102 is opened. In the first embodiment, for example, the lid member 103 is configured of a screw type lid in which a male screw portion is formed. At a time when ink is poured, the lid member 103 including the male screw portion is removed from the air introduction portion 102 configured of the female screw hole such that the air-tightly closed air introduction portion 102 is opened, pouring out of ink via the spout portion 100*a* is prompted, and the ink in the liquid bottle 100 inserted into the pouring port 64 is poured into the liquid accommodating chamber 55 of the liquid accommodating body 30 (30*a*).

At this time, after the ink in the liquid bottle 100 pours out via the spout portion 100*a*, the ink falls from the spout portion 100*a* in the gravity direction in the form of liquid droplets (ink droplets) due to the surface tension or the like thereof and falls to a predetermined region in the bottom wall 60 positioned in the gravity direction, that is, a falling region. When ink (liquid droplets) falls to the falling region, ink bubbles BL are generated on the surface KS of ink which is positioned in the vicinity of the lower limit denoting portion 70.

At this time, in the liquid accommodating body 30 according to the first embodiment, the surface KS of ink in the pouring port side liquid accommodating chamber 55A which is positioned in the vicinity of the lower limit denoting portion 70 is positioned above the liquid communication portion 57 since the liquid communication portion 57 is positioned closer to the gravity direction side than the lower limit denoting portion 70 is. As a result, the bubbles BL generated on the surface KS of ink are retained in an area above the liquid communication portion 57 which is closer to the counter-gravity direction side than the liquid communication portion 57 is. Therefore, the bubbles BL are inhibited from flowing into the visual recognition portion side liquid accommodating chamber 55B from the pouring port side liquid accommodating chamber 55A. Accordingly, ink poured into the pouring port side liquid accommodating chamber 55A flows into the visual recognition portion side liquid accommodating chamber 55B from the pouring port side liquid accommodating chamber 55A via the liquid communication portion 57 in a state where the ink includes almost no bubbles BL.

Thereafter, as the pouring of ink into the pouring port side liquid accommodating chamber 55A continues, the surface KS of ink rises toward the upper limit denoting portion 69 as illustrated with a white arrow in FIG. 5. At this time, in the pouring port side liquid accommodating chamber 55A, the surface KS of ink rises with the bubbles BL being present on the surface KS. Meanwhile, in the visual recognition portion side liquid accommodating chamber 55B, the surface KS of ink rises with almost no bubbles BL being present on the surface KS.

Note that, when the surface KS of ink rises, air in the pouring port side liquid accommodating chamber 55A is discharged to the outside of the container via the atmosphere communication portion 63A and air in the visual recognition portion side liquid accommodating chamber 55B is discharged to the outside of the container via the atmosphere communication portion 63B. Accordingly, the position of the surface KS of ink in the pouring port side liquid accommodating chamber 55A substantially coincides with the position of the surface KS of ink in the visual recognition portion side liquid accommodating chamber 55B and the position of the surface KS of ink which is visually recognized through the visual recognition portion 68 is a position corresponding to the amount of ink which is accommodated in the liquid accommodating chamber 55 through the pouring operation.

Therefore, at the time of the ink pouring operation, the user can visually recognize a change (rise) in position of the surface KS of ink in the liquid accommodating chamber 55 appropriately via the visual recognition portion 68. When the height of the surface KS of ink in the liquid accommodating chamber 55 increases and the surface KS reaches the upper limit denoting portion 69 provided on the upper portion of the visual recognition portion 68, the user attaches the lid member 103 to the air introduction portion 102 to air-tightly close the air introduction portion 102 again. Thereafter, the user draws the spout portion 100*a* of the liquid bottle 100 from the pouring port 64 and closes the pouring port 64 again by using the plug 65. Then, the user rotates the covering member 26 in the opening position such that the covering member 26 is displaced to the closing position and covers the pouring port 64 of each liquid accommodating body 30 with the covering member 26. In this manner, the ink pouring operation is finished.

In some cases, the pouring operation is started in a state where the position of the surface KS at the visual recognition portion 68 is lower than that of the vicinity of the lower limit denoting portion 70 while being closer to the gravity direction side than the vicinity of the lower limit denoting portion 70 is. In this case, the surface KS of ink in the liquid accommodating chamber 55 (pouring port side liquid accommodating chamber 55A) may be present in a gap as the liquid communication portion 57 which is positioned closer to the gravity direction side than the lower limit denoting portion 70 is.

Even in this case, since the liquid communication portion 57 is formed between the lower end of the partition wall 56 and the bottom wall 60, a gap between the surface KS of ink and the lower end of the partition wall 56 is smaller than the gap as the liquid communication portion 57. Accordingly, the bubbles BL generated in the pouring port side liquid accommodating chamber 55A are likely to be retained in the pouring port side liquid accommodating chamber 55A. As a result, inflow of the generated bubbles BL of ink into the visual recognition portion side liquid accommodating chamber 55B from the pouring port side liquid accommodating chamber 55A via the liquid communication portion 57 is suppressed. Note that, since the liquid repellent treatment is performed on the inner wall of the visual recognition portion 68, in a case where the bubbles BL of ink flows into the visual recognition portion side liquid accommodating chamber 55B from the pouring port side liquid accommodating chamber 55A, the bubbles BL of ink flowing into the visual recognition portion side liquid accommodating chamber 55B adhering to the inner wall of the visual recognition portion 68 are suppressed.

According to the liquid accommodating body 30 in the first embodiment, the following effects can be achieved.

(1) Since it is possible to suppress the inflow of the bubbles BL, which are generated at the time when ink are poured, into the visual recognition portion side liquid accommodating chamber 55B from the pouring port side liquid accommodating chamber 55A, the visibility of the surface KS of ink through the visual recognition portion 68 is improved.

(2) Since the liquid repellent treatment is performed on the inner wall of the visual recognition portion 68 which is on the liquid accommodating chamber 55 side (visual recognition portion side liquid accommodating chamber 55B side), the visibility of the surface KS of ink through the visual recognition portion 68 is improved.

(3) Since the atmosphere communication portion 63B through which the visual recognition portion side liquid accommodating chamber 55B and the atmosphere communicate with each other is provided, the position of the surface KS of ink which is visually recognized through the visual recognition portion 68 is a position corresponding to the amount of accommodated ink. Therefore, the liquid accommodating body 30 is suitable as a liquid accommodating body into which ink can be accommodated through the pouring operation.

(4) Since the position of the surface KS of ink in the pouring port side liquid accommodating chamber 55A being lower than that of the liquid communication portion 57, which is positioned closer to the gravity direction side than the lower limit denoting portion 70 is, is suppressed, the bubbles BL are less likely to flow into the visual recognition portion side liquid accommodating chamber 55B from the pouring port side liquid accommodating chamber 55A and the visibility of the surface KS of ink through the visual recognition portion 68 is improved.

Liquid Accommodating Body in Second Embodiment

Next, the configurations of the liquid accommodating bodies 30 in a second embodiment which are included in the liquid ejecting apparatus 12 will be described. Note that, the liquid accommodating bodies 30 in the second embodiment are substantially the same as the liquid accommodating bodies 30 in the first embodiment except for the configuration of the partition wall 56 by which the liquid accommodating chamber 55 is partitioned into the pouring port side liquid accommodating chamber 55A and the visual recognition portion side liquid accommodating chamber 55B. Therefore, in the following description, components in the second embodiment which are different from those in the first embodiment will be mainly described and repetitive description of the other components will be omitted with the other components being given the same reference numerals.

Figure 6:
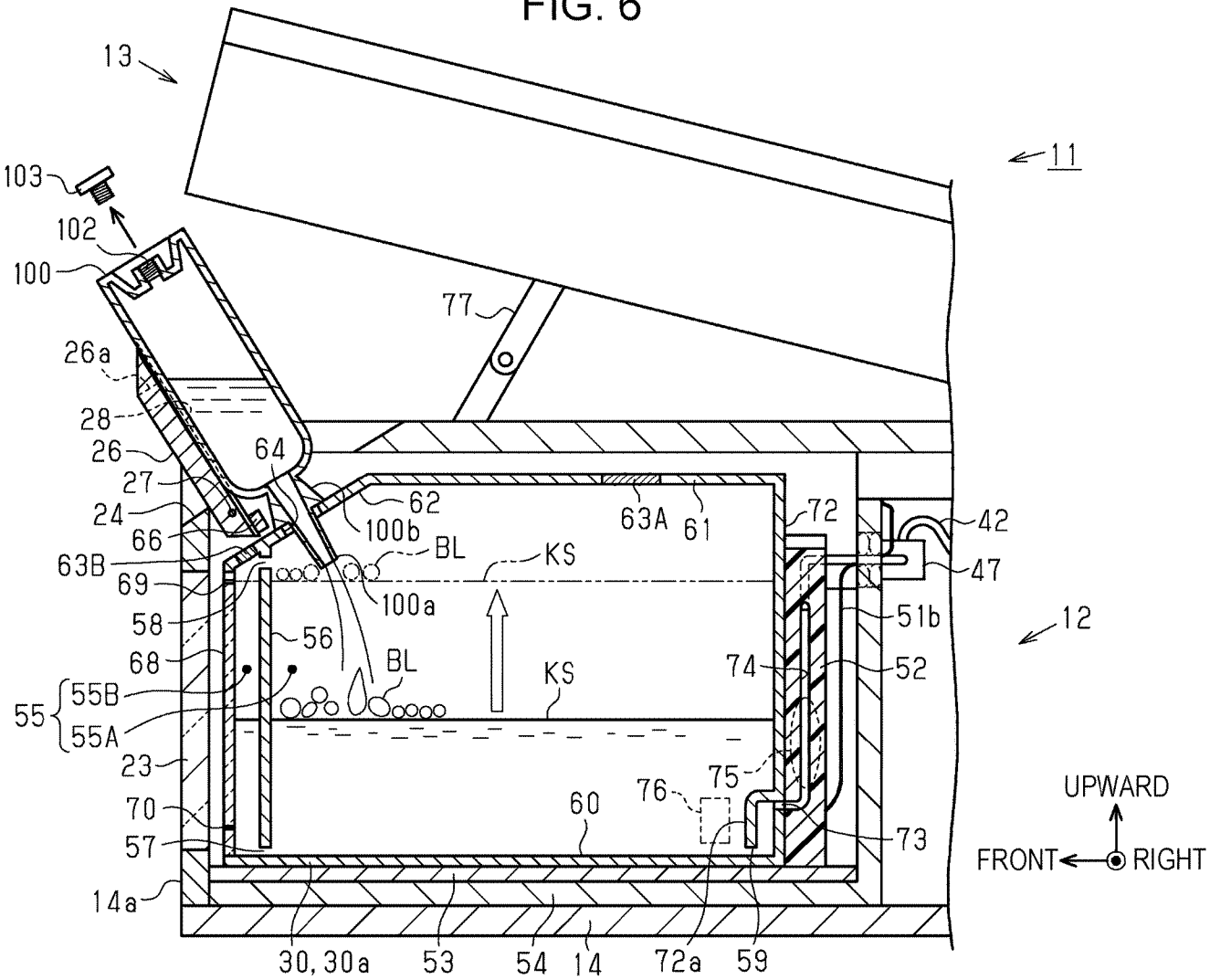
FIG. 6 is a partial sectional view illustrating a state where liquid is poured into a liquid accommodating body according to a second embodiment in the liquid ejecting apparatus according to the first embodiment.

As illustrated in FIG. 6, in the liquid accommodating body 30 according to the second embodiment, the partition wall 56, by which the liquid accommodating chamber 55 is partitioned into two accommodating chambers of the pouring port side liquid accommodating chamber 55A and the visual recognition portion side liquid accommodating chamber 55B, is provided with an upper communication portion 58 that is positioned closer to the counter-gravity direction side than the upper limit denoting portion 69 is and through which the pouring port side liquid accommodating chamber 55A and the visual recognition portion side liquid accommodating chamber 55B communicate with each other.

That is, in the liquid accommodating chamber 55, a slit-shaped gap that has a predetermined width in the vertical direction and has a predetermined length in the transverse direction is formed in the vicinity of the upper end of the flat plate-shaped partition wall 56 extending in the vertical direction, which is connected to the inclined surface wall portion 62 at the position between the pouring port 64 and the atmosphere communication portion 63B, as the upper communication portion 58. In addition, the upper communication portion 58 is positioned closer to the counter-gravity direction side than the upper limit denoting portion 69 provided on the visual recognition portion 68 is.

In the liquid accommodating body 30 according to the second embodiment, when pouring ink into the liquid accommodating chamber 55 through the pouring port 64, an effect different from that in the liquid accommodating body 30 of the first embodiment is obtained. The effect will be described below.

In a case of the liquid accommodating body 30 in the first embodiment (refer to FIG. 5), when ink is poured into the liquid accommodating chamber 55 and the surface KS of ink rises, air in the pouring port side liquid accommodating chamber 55A is discharged to the atmosphere through the atmosphere communication portion 63A with the rise of the surface KS of ink. Meanwhile, air in the visual recognition portion side liquid accommodating chamber 55B is discharged to the atmosphere through the atmosphere communication portion 63B with the rise of the surface KS of ink. Therefore, there is a case where the air pressure in the pouring port side liquid accommodating chamber 55A becomes different from the air pressure in the visual recognition portion side liquid accommodating chamber 55B corresponding to a difference between the volume of air discharged through the atmosphere communication portion 63A and the volume of air discharged through the atmosphere communication portion 63B. In this case, the position of the surface KS of ink in the pouring port side liquid accommodating chamber 55A may not coincide with the position of the surface KS of ink in the visual recognition portion side liquid accommodating chamber 55B.

On the other hand, as illustrated in FIG. 6, in the liquid accommodating body 30 according to the second embodiment, air in the pouring port side liquid accommodating chamber 55A and air in the visual recognition portion side liquid accommodating chamber 55B communicate with each other through the upper communication portion 58. Accordingly, when ink is poured into the liquid accommodating chamber 55 and the surface KS of ink rises, the value of the air pressure in the pouring port side liquid accommodating chamber 55A and the value of the air pressure in the visual recognition portion side liquid accommodating chamber 55B are equalized. As a result, the position of the surface KS of ink in the pouring port side liquid accommodating chamber 55A is not likely to become different from the position of the surface KS of ink in the visual recognition portion side liquid accommodating chamber 55B.

Note that, as illustrated with a white arrow in FIG. 6, when ink is poured into the liquid accommodating chamber 55 and the surface KS of ink rises up to the upper limit denoting portion 69, the surface KS of ink in the pouring port side liquid accommodating chamber 55A is positioned closer to the gravity direction side than the upper communication portion 58 is. As a result, the bubbles BL generated on the surface KS of ink are retained in an area below the upper communication portion 58 which is closer to the gravity direction side than the upper communication portion 58 is. Accordingly, inflow of the bubbles BL the visual recognition portion side liquid accommodating chamber 55B from the pouring port side liquid accommodating chamber 55A via the upper communication portion 58 is suppressed.

According to the liquid accommodating body 30 in the second embodiment, the following effects can be achieved in addition to the above-described effects (1) to (4) in the first embodiment.

(5) Since the position of the surface KS of ink in the visual recognition portion side liquid accommodating chamber 55B being different from the position of the surface KS of ink in the pouring port side liquid accommodating chamber 55A is suppressed due to the upper communication portion 58, the positional accuracy of the surface KS of ink at the visual recognition portion 68 increases. In addition, since the upper communication portion 58 is positioned above the upper limit denoting portion 69 and inflow of the bubbles BL of ink in the pouring port side liquid accommodating chamber 55A into the visual recognition portion side liquid accommodating chamber 55B is suppressed, the positional accuracy of the surface KS of ink at the visual recognition portion 68 increases.

Liquid Accommodating Body in Third Embodiment

Next, the configurations of the liquid accommodating bodies 30 in a third embodiment which are included in the liquid ejecting apparatus 12 will be described. Note that, the liquid accommodating bodies 30 in the third embodiment are substantially the same as the liquid accommodating bodies 30 in the first embodiment except for the configuration of the bottom wall 60 which forms the liquid accommodating chamber 55. Therefore, in the following description, components in the third embodiment which are different from those in the first embodiment will be mainly described and repetitive description of the other components will be omitted with the other components being given the same reference numerals.

Figure 7:
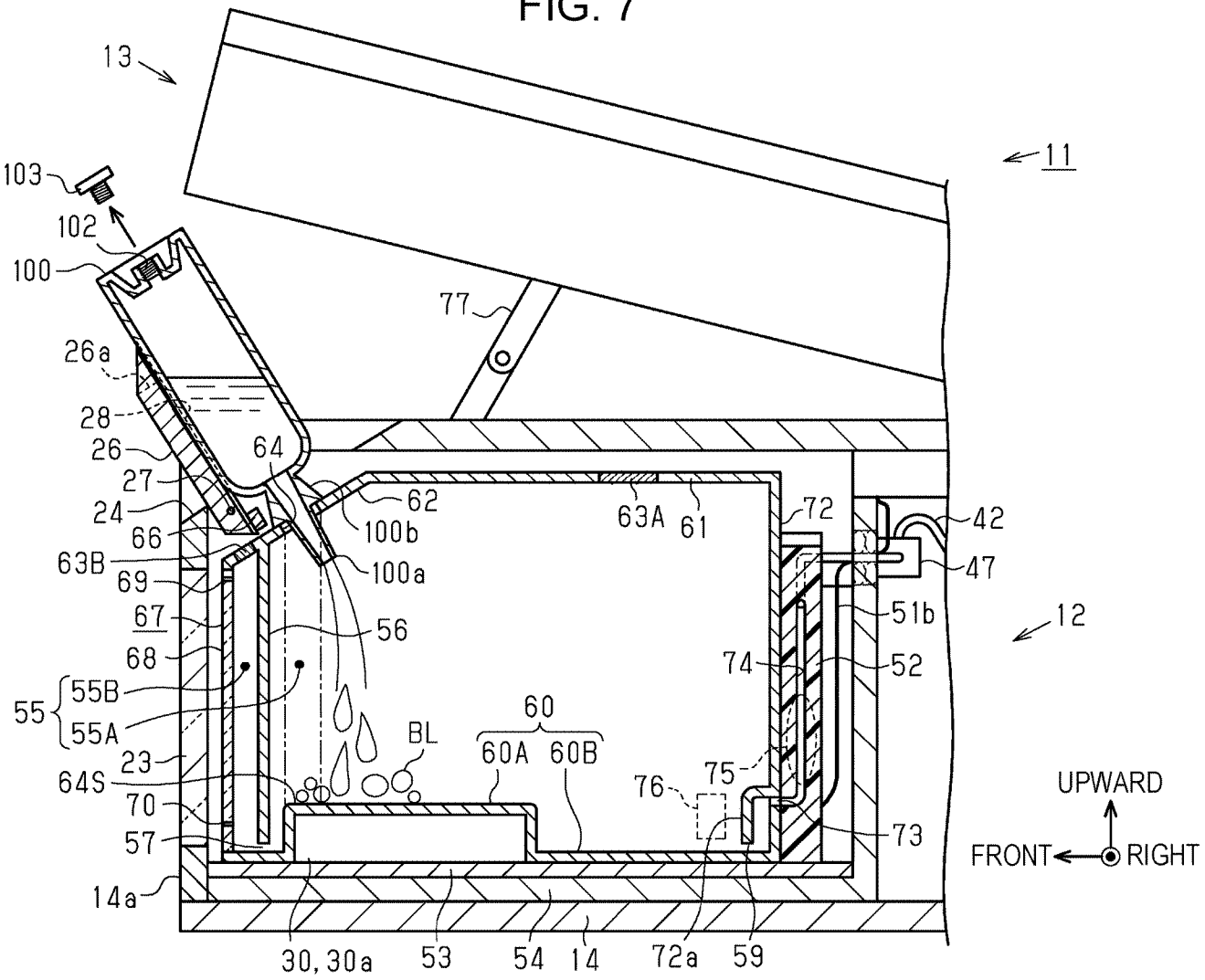
FIG. 7 is a partial sectional view illustrating a state where liquid is poured into a liquid accommodating body according to a third embodiment in the liquid ejecting apparatus according to the first embodiment.

As illustrated in FIG. 7, in the liquid accommodating body 30 in the third embodiment, the falling region on the bottom wall 60 in the pouring port side liquid accommodating chamber 55A, to which ink poured through the pouring port 64 falls, is a wall surface that is positioned closer to the counter-gravity direction side than the liquid communication portion 57 is.

That is, the bottom wall 60 that forms the liquid accommodating chamber 55 is configured of a low bottom wall 60B of which a wall surface forms the liquid communication portion 57 between the wall surface and the partition wall 56 and a high bottom wall 60A of which a wall surface is positioned closer to the counter-gravity direction side than the wall surface of the lower bottom wall 60B is. At least a portion of the wall surface of the high bottom wall 60A is the falling region onto which ink poured through the pouring port 64 falls and the liquid communication portion 57 is positioned closer to the gravity direction side than the falling region of ink on the bottom wall 60 in the pouring port side liquid accommodating chamber 55A is.

Note that, in the third embodiment, a wall surface of the high bottom wall 60A which is the falling region of ink is a flat surface approximately parallel to the low bottom wall 60B and as illustrated with a two-dot chain line in FIG. 7, a projection region 64S of the pouring port 64 in the vertical direction (gravity direction) is positioned in the flat surface. Incidentally, in the third embodiment, the high bottom wall 60A is a portion of the bottom wall 60 that is formed to have a region, of which a dimension in the front/rear direction of is smaller than a dimension in the front/rear direction of the bottom wall 60 and of which a dimension in the transverse direction is smaller than a dimension in the transverse direction of the bottom wall 60, and that protrudes toward the counter-gravity direction side and the region other than the above-described protruding portion forms the low bottom wall 60B.

In the liquid accommodating body 30 according to the third embodiment, when pouring ink into the liquid accommodating chamber 55 through the pouring port 64, an effect different from that in the liquid accommodating body 30 of the first embodiment is obtained. The effect will be described below.

As illustrated in FIG. 7, ink poured into the liquid accommodating chamber 55 through the spout portion 100*a* falls onto a wall surface of the high bottom wall 60A in the pouring port side liquid accommodating chamber 55A which is the falling region. When ink falls, ink bubbles BL are generated on the wall surface of the high bottom wall 60A in the pouring port side liquid accommodating chamber 55A.

At this time, since the wall surface (falling region) of the high bottom wall 60A is positioned closer to the gravity direction side than the liquid communication portion 57 is, the generated bubbles BL are retained in an area above the liquid communication portion 57 which is closer to the counter-gravity direction side than the liquid communication portion 57 is. Therefore, inflow of the bubbles BL into the visual recognition portion side liquid accommodating chamber 55B from the pouring port side liquid accommodating chamber 55A is suppressed.

According to the liquid accommodating body 30 in the third embodiment, the following effects can be achieved in addition to the above-described effects (1) to (4) in the first embodiment and the above-described effect (5) in the second embodiment.

(6) Since inflow of the bubbles BL, which are generated on the falling region when ink poured into the pouring port side liquid accommodating chamber 55A falls, into the visual recognition portion side liquid accommodating chamber 55B from the pouring port side liquid accommodating chamber 55A is suppressed, the visibility of the surface KS of ink through the visual recognition portion 68 is improved.

Liquid Accommodating Body in Fourth Embodiment

Next, the configurations of the liquid accommodating bodies 30 in a fourth embodiment which are included in the liquid ejecting apparatus 12 will be described. Note that, the liquid accommodating bodies 30 in the fourth embodiment are substantially the same as the liquid accommodating bodies 30 in the third embodiment except that the configuration of the bottom wall 60, which forms the liquid accommodating chamber 55, has been changed from the configuration of the bottom wall 60, which forms the liquid accommodating chamber 55, according to the third embodiment. Therefore, in the following description, components in the fourth embodiment which are different from those in the third embodiment will be mainly described and repetitive description of the other components will be omitted with the other components being given the same reference numerals.

Figure 8:
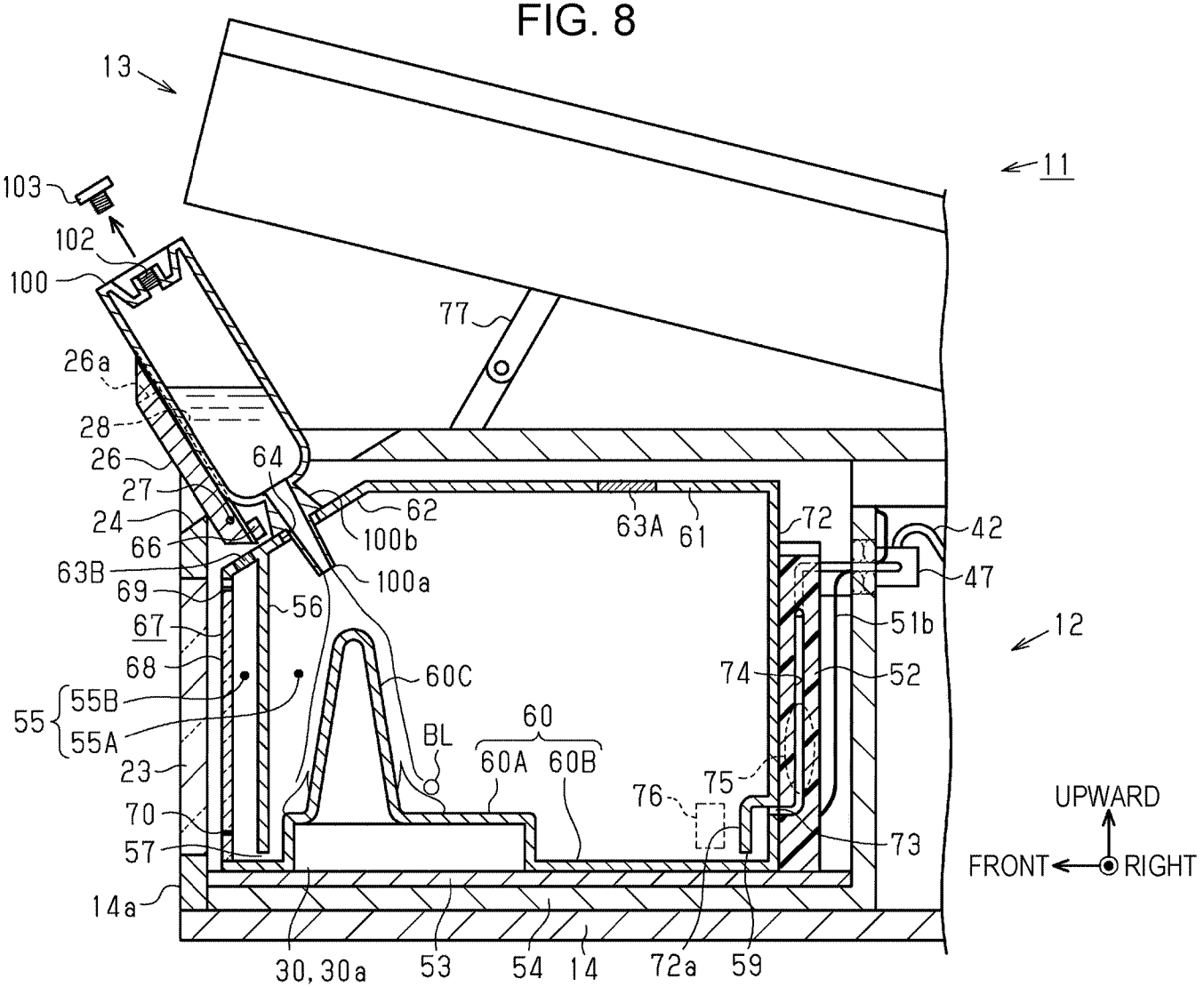
FIG. 8 is a partial sectional view illustrating a state where liquid is poured into a liquid accommodating body according to a fourth embodiment in the liquid ejecting apparatus according to the first embodiment.

As illustrated in FIG. 8, in the liquid accommodating body 30 according to the fourth embodiment, a protruding bottom wall 60C is formed to protrude toward the top wall from the high bottom wall 60A in the pouring port side liquid accommodating chamber 55A of the liquid accommodating body 30 according to the third embodiment. Incidentally, the protruding bottom wall 60C is formed to have a mountain-like shape of which the protrusion end has a cylindrical surface of which the axial direction is parallel to the transverse direction. Alternatively, the protruding bottom wall 60C is formed to have a cone-like shape of which the protrusion end has a spherical surface (semi-spherical surface). In addition, the protruding bottom wall 60C is formed such that the protrusion end thereof is positioned closest to the pouring port 64.

In the liquid accommodating body 30 according to the fourth embodiment, when pouring ink into the liquid accommodating chamber 55 through the pouring port 64, an effect different from that in the liquid accommodating body 30 of the third embodiment is obtained. The effect will be described below.

As illustrated in FIG. 8, ink poured into the liquid accommodating chamber 55 falls from the spout portion 100*a* to the protruding bottom wall 60C in the pouring port side liquid accommodating chamber 55A in the gravity direction and falls onto the protrusion end of the protruding bottom wall 60C which is closest to the pouring port 64. At this time, since the distance by which the poured ink falls from the spout portion 100*a* until reaching the protrusion end of the protruding bottom wall 60C is short, the ink is not likely to become ink droplets when falling onto the protrusion end and the speed (falling speed) of the ink is low when the ink reaches the protrusion end. As a result, generation of the bubbles BL which occurs when the ink falls onto the protruding bottom wall 60C is suppressed. Furthermore, after ink falls onto the protrusion end of the protruding bottom wall 60C, the ink flows along an inclined surface of the mountain shape or an inclined surface (side surface) of the cone shape. Therefore, the amount of bubbles BL generated due to the flowing of the ink becomes small. Note that, in the case of a configuration in which the spout portion 100*a* of the liquid bottle 100 is inserted into the pouring port 64 in the vertical direction, it is preferable that the protruding bottom wall 60C be formed on the high bottom wall 60A with the protrusion end thereof being positioned immediately below the pouring port 64.

According to the liquid accommodating body 30 in the fourth embodiment, the following effects can be achieved in addition to the above-described effects (1) to (4) in the first embodiment, the above-described effect (5) in the second embodiment and the above-described effect (6) in the third embodiment.

(7) Since the bubbles BL are less likely to be generated when the ink poured through the spout portion 100*a* falls onto the falling region (protruding bottom wall 60C), inflow of the bubbles BL into the visual recognition portion side liquid accommodating chamber 55B from the pouring port side liquid accommodating chamber 55A is suppressed. Therefore, the visibility of the surface KS of ink through the visual recognition portion 68 is improved.

Note that, the above-described embodiments may be modified as follows.

- The protrusion end of the protruding bottom wall 60C in the liquid accommodating body 30 according to the fourth embodiment may have a mountain-shaped surface or a shape with a vertex angle instead of the cylindrical surface and the spherical surface.
- The protruding bottom wall 60C in the liquid accommodating body 30 according to the fourth embodiment may be formed on the bottom wall 60 in the liquid accommodating body 30 according to the first embodiment or the bottom wall 60 in the liquid accommodating body 30 according to the second embodiment.
- The configuration of the liquid accommodating body 30 according to the second embodiment (upper communication portion 58) may be adopted for the liquid accommodating body 30 according to the third embodiment or the liquid accommodating body 30 according to the fourth embodiment.
- In the liquid accommodating body 30 in the above-described embodiments, the atmosphere communication portion 63A which communicates with the pouring port side liquid accommodating chamber 55A may not be provided. That is, a configuration provided with at least the atmosphere communication portion 63B, through which the visual recognition portion side liquid accommodating chamber 55B communicates with the atmosphere, may be adopted.

For example, in the above-described liquid accommodating body 30 according to the second embodiment, air in the visual recognition portion side liquid accommodating chamber 55B and air in the pouring port side liquid accommodating chamber 55A communicate with each other through the upper communication portion 58. Therefore, air in the pouring port side liquid accommodating chamber 55A communicates with the atmosphere through the atmosphere communication portion 63B. Accordingly, the atmosphere communication portion 63A may not be provided. Alternatively, in the liquid accommodating body 30 according to the first, third, and fourth embodiments, the atmosphere communication portion 63A may not be provided in a case where the pouring port side liquid accommodating chamber 55A can communicate with the atmosphere through the pouring port 64.

- In the liquid accommodating body 30 according to the above-described embodiments, both of the atmosphere communication portion 63A through which the pouring port side liquid accommodating chamber 55A communicates with the atmosphere and the atmosphere communication portion 63B through which the visual recognition portion side liquid accommodating chamber 55B communicates with the atmosphere may not be provided. For example, in the liquid accommodating body 30 according to the above-described embodiments, the atmosphere communication portions 63A and 63B may not be provided in a case where air is sent into the liquid accommodating chamber 55 corresponding to the amount of supplied ink.
- In the liquid accommodating body 30 according to the above-described embodiments, the liquid communication portion 57 may not be positioned closer to the gravity direction side than the lower limit denoting portion 70 provided on the visual recognition portion 68 is. For example, the above-described configuration may be adopted in a case where a dimension of a gap between the bottom wall 60 that forms the pouring port side liquid accommodating chamber 55A and the lower end of the partition wall 56 is smaller than the average size (diameter) of the generated bubbles BL so that inflow of the bubbles BL into the visual recognition portion side liquid accommodating chamber 55B from the pouring port side liquid accommodating chamber 55A is suppressed. Alternatively, the above-described configuration may be adopted in a case where the position of the surface KS that indicates the lower limit of the amount of ink remaining in the liquid accommodating chamber 55 and is detected by the residual amount detecting unit 76 is positioned above (counter-gravity direction) the liquid communication portion 57.
- In the liquid accommodating body 30 according to the above-described embodiments, the liquid repellent treatment may not be performed on the inner wall of the visual recognition portion 68 which is on the liquid accommodating chamber 55 side. For example, the liquid repellent treatment is not necessary in a case where the position of the surface KS of ink can be confirmed.

In the liquid accommodating body 30 according to the above-described embodiments, the entire accommodating body main body 30A may be formed of transparent or translucent material so that the surface KS of ink can be visually recognized through the accommodating body main body 30A and a portion of a wall surface of the front wall portion 67 that forms the liquid accommodating chamber 55 may function as the visual recognition portion 68. In this case, it is preferable that the liquid repellent treatment be performed on at least a portion of an inner wall of the front wall portion 67 of the liquid accommodating chamber 55 which is on the liquid accommodating chamber 55 side and functions as the visual recognition portion 68.

In the liquid accommodating body 30 according to the above-described embodiments, the top wall may be configured of only the horizontal wall portion 61 without including the inclined surface wall portion 62. That is, the liquid accommodating body 30 may have a rectangular shape as seen in the transverse direction. In this case, the pouring port 64 and the atmosphere communication portion 63B are preferably formed in the vicinity of the front end of the horizontal wall portion 61.

The liquid accommodating bodies 30 of the above-described embodiments may be individually formed for each ink color and the liquid accommodating bodies 30 for a plurality of colors (or all colors) may be integrally formed with each other.

Liquid Ejecting Apparatus in Second Embodiment

Next, a second embodiment of the liquid ejecting apparatus 12 will be described. Note that, in the following description, components of the liquid ejecting apparatus 12 in the second embodiment which are different from those in the first embodiment will be mainly described and repetitive description of the other components will be omitted with the other components being given the same reference numerals.

Figure 9:
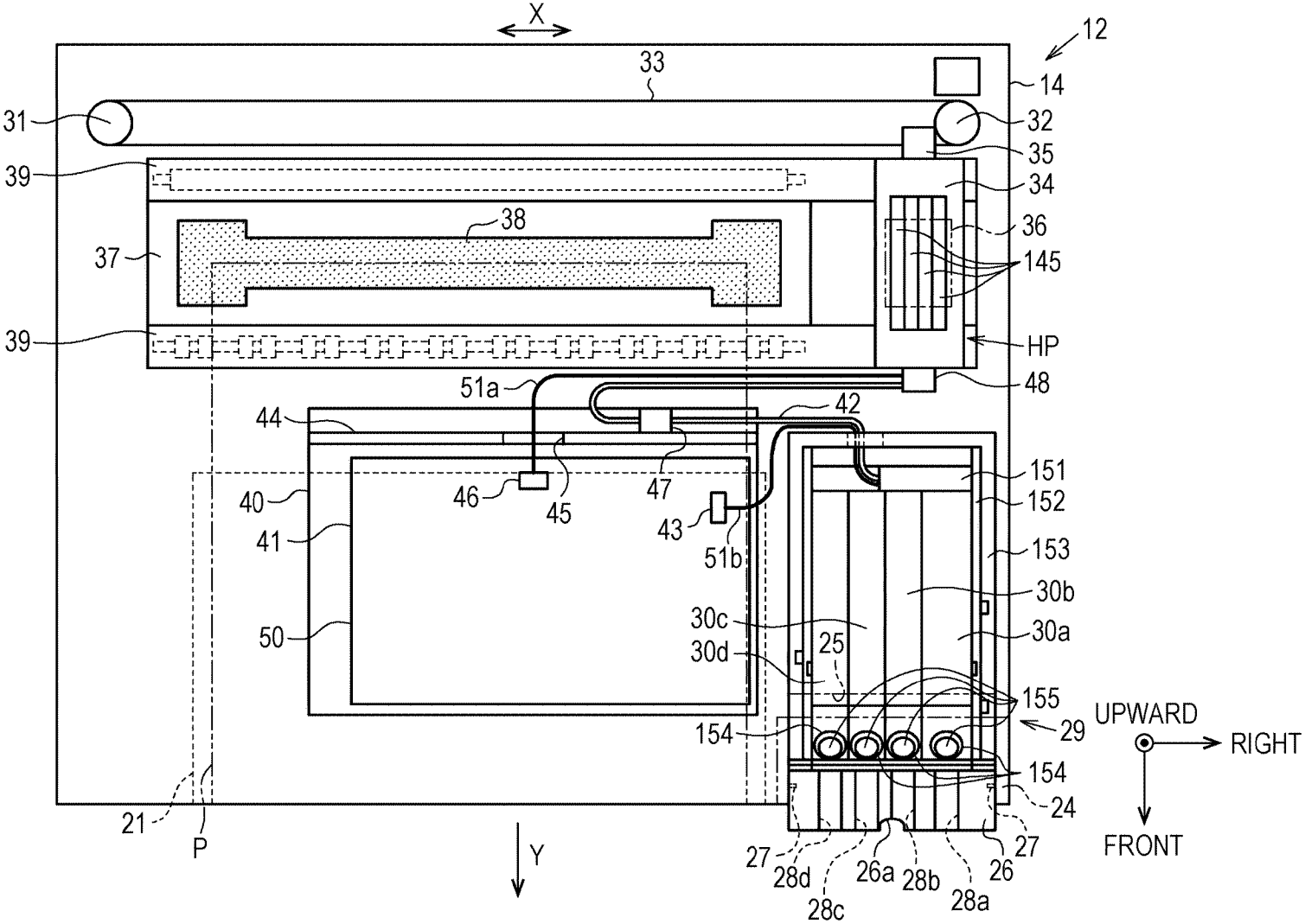
FIG. 9 is a schematic plane sectional view of a liquid ejecting apparatus according to a second embodiment which is taken along line IX-IX in FIG. 1.

As illustrated in FIG. 9, in the liquid ejecting apparatus 12 according to the second embodiment, one end of each liquid supply tube 42 is connected to the liquid supply unit 29 and each liquid supply tube 42 is flexible. A portion of the each liquid supply tube 42, which is closer to the other end of each liquid supply tube 42 than the fixing member 47 that supports an intermediate portion of each liquid supply tube 42 is, is folded back after extending in the scanning direction X and is connected to the carriage 34 via the connection portion 48. In addition, the other end of each liquid supply tube 42 is connected to each intermediate storage body 145 installed on the carriage 34.

Liquid supplied via each liquid supply tube 42 is temporarily stored in each intermediate storage body 145 before the liquid is supplied to the liquid ejecting head 36. The number of the plurality of (four in second embodiment) liquid supply tubes 42 routed is the same as the number of the plurality of (four in second embodiment) liquid accommodating bodies 30*a* to 30*d*. However, in FIG. 9 or the like, only one liquid supply tube 42 is illustrated and three liquid supply tubes 42 among the four liquid supply tubes 42 are omitted for the purpose of simplification. In addition, the plurality of liquid supply tubes 42 are preferably configured as a multiple tube that is obtained by integrally forming the plurality of liquid supply tubes with each other. The liquid supply tubes 42 constitute a portion of a liquid supply flow path 146 that connects the liquid accommodating bodies 30 and the liquid ejecting head 36 such that liquid accommodated in the liquid accommodating bodies 30 (30*a* to 30*d*) can be supplied to the liquid ejecting head 36.

In addition, one end of the signal wire 51*a*, which leads out of the connection portion 48 of the carriage 34 and of which the other end is connected to the liquid ejecting head 36 or the like, and one end of the signal wire 51*b* of which the other end is connected to the liquid supply unit 29 are connected to a controller 50 via different connectors 43.

Next, the liquid supply unit 29 will be described. As illustrated in FIG. 9, the liquid supply unit 29 is configured to include the plurality of liquid accommodating bodies 30*a* to 30*d*, a flow path forming member 151 in which an ink flow path connected to the liquid accommodating bodies 30*a* to 30*d* is formed, and a setting member 152 (refer to FIG. 9) in which the plurality of liquid accommodating bodies 30*a* to 30*d* are set along with the flow path forming member 151 in a state where the liquid accommodating bodies 30*a* to 30*d* are arranged side by side. In addition, the liquid supply unit 29 is retained while being positioned at a predetermined position with respect to a holder 153 (holding member) in the housing 14.

Each of the plurality of liquid accommodating bodies 30*a* to 30*d* is an ink tank having an approximately rectangular parallelepiped shape. A plurality of different kinds of ink (having plurality of colors) such as black ink, cyan ink, magenta ink, and yellow ink are respectively accommodated in the plurality of liquid accommodating bodies 30*a* to 30*d*. Note that, in an example illustrated in FIG. 9, the large capacity type liquid accommodating body 30*a*, which accommodates black liquid and is disposed on the outermost side in the plurality of liquid accommodating bodies 30*a* to 30*d*, is thicker than the other three liquid accommodating bodies 30*b* to 30*d*. However, the sizes (thickness) of the liquid accommodating bodies 30*a* to 30*d* may be the same as each other.

As illustrated in FIG. 9, when the covering member 26 is rotated from the closing position to the opening position, a pouring port 154 of the liquid accommodating body 30 is exposed to the outside. In a case where the covering member 26 is in the opening position, the covering member 26 is held in a posture which is substantially parallel to the axis of the pouring port 154 of the liquid accommodating body 30 and is oblique to the horizontal plane by a predetermined angle. The pouring port 154 is capped by a plug 155 formed of rubber or the like in a usual state. For example, a user mounts the liquid bottle 100 (liquid pouring member) (refer to FIG. 13) on the rear surface of the covering member 26, inserts the spout portion of the liquid bottle 100 into the pouring port 154, and pours liquid from the liquid bottle 100 into the liquid accommodating body 30.

Next, a liquid supply mechanism 160, which is provided for each type of liquid to be ejected by the liquid ejecting head 36, will be described with reference to FIG. 10.

Figure 10:
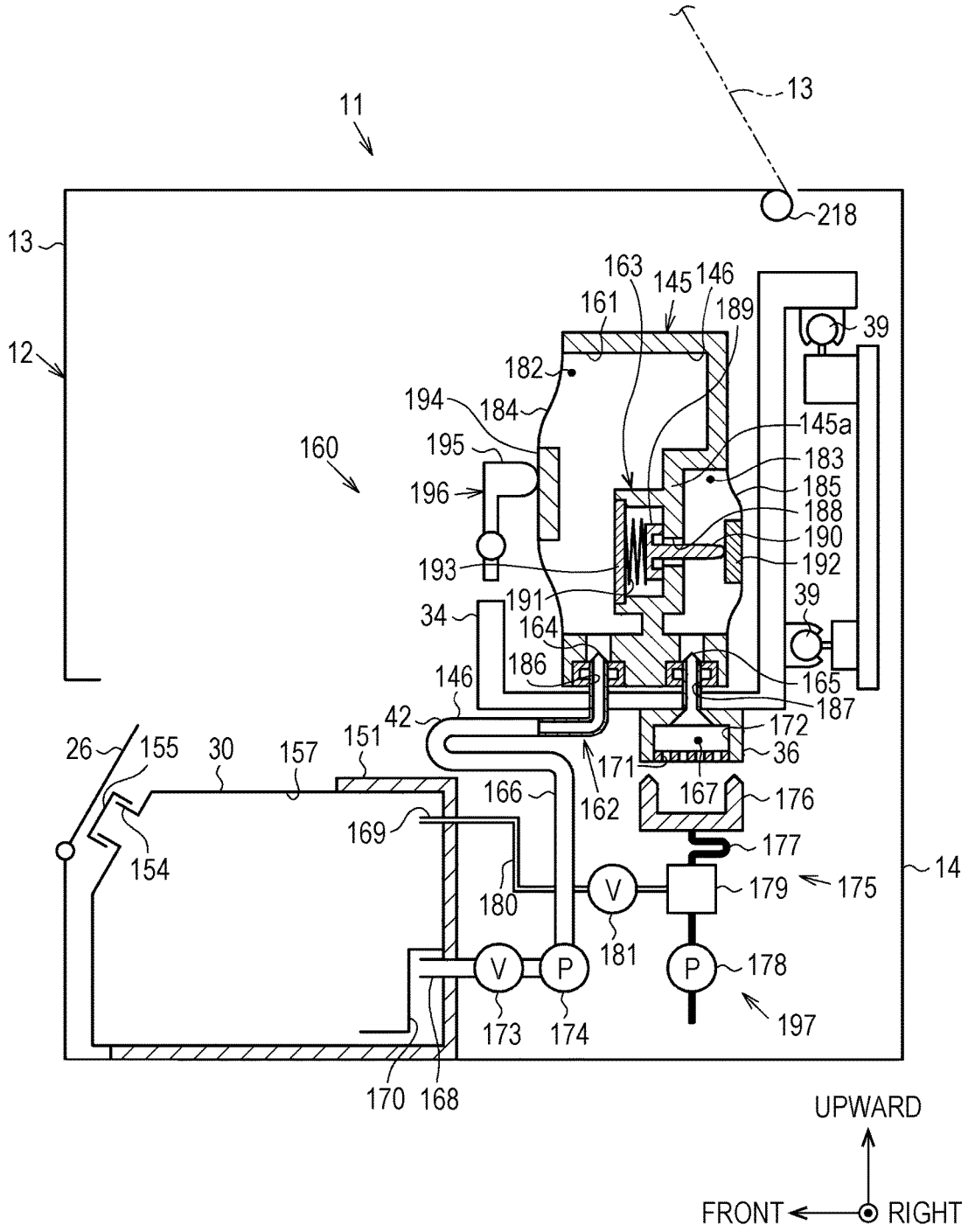
FIG. 10 is a schematic sectional view illustrating a liquid supply system in the liquid ejecting apparatus according to the second embodiment.

As illustrated in FIG. 10, the liquid supply mechanism 160 is provided with the liquid supply flow path 146 that connects the liquid accommodating bodies 30 and the liquid ejecting head 36 such that liquid accommodated in the liquid accommodating bodies 30 can be supplied to the liquid ejecting head 36. The liquid supply flow path 146 includes an intermediate storage body connection portion 162 which can be connected the intermediate storage body 145 that includes an intermediate storage portion 161 in which liquid can be stored. The intermediate storage body connection portion 162 is positioned between the liquid accommodating bodies 30 and the liquid ejecting head 36.

The intermediate storage body 145 functions as a sub tank that is provided above the carriage 34 and that is mounted such that the intermediate storage body 145 can be detached with respect to the intermediate storage body connection portion 162. The intermediate storage body 145 in the second embodiment includes a built-in pressure adjustment mechanism 163 that adjusts the pressure of liquid (liquid pressure) in the liquid ejecting head 36 to a set pressure within a predetermined range and can supply liquid to the liquid ejecting head 36. The intermediate storage body connection portion 162 includes an introduction needle portion 164 and a supply needle portion 165 which protrude upwards from the carriage 34. Each of the introduction needle portion 164 and the supply needle portion 165 is configured of a pipe-shaped member of which a tip end portion has a needle-like shape so that the tip end portion can be inserted into an elastic member such as rubber and in which a flow path, through which liquid can flow, is provided. Note that, details of the configuration of the intermediate storage body 145 will be described later.

The liquid supply flow path 146 that connects the liquid accommodating bodies 30 and the liquid ejecting head 36 includes an upstream side liquid supply flow path 166 which is on the upstream side of the intermediate storage body connection portion 162 (specifically, introduction needle portion 164) and a downstream side liquid supply flow path 167 which is on the downstream side of the intermediate storage body connection portion 162 (specifically, supply needle portion 165). In the second embodiment, a liquid filling method of filling the liquid supply flow path 146 with liquid by using liquid in the intermediate storage portion 161 of the intermediate storage body 145 that is connected to the intermediate storage body connection portion 162 is adopted. The liquid filling method includes a first filling process of filling the upstream side liquid supply flow path 166 with liquid by using liquid flowing to the liquid accommodating body 30 on the upstream side from the intermediate storage body 145 connected to the intermediate storage body connection portion 162 and a second filling process of filling the downstream side liquid supply flow path 167 with liquid by using liquid flowing to the liquid ejecting head 36 on the downstream side from the intermediate storage body 145.

As illustrated in FIG. 10, the liquid accommodating body 30 includes a liquid accommodating chamber 157 that can accommodate liquid. The liquid accommodating body 30 includes the above-described pouring port 154 through which ink can be poured into the liquid accommodating chamber 157 from the outside, a supply port portion 168 through which liquid in the liquid accommodating chamber 157 is supplied toward the upstream side liquid supply flow path 166 side, and an atmosphere communication hole 169 through which a region in the liquid accommodating chamber 157, in which liquid is not accommodated (that is, region in which gas is accommodated), communicates with the atmosphere. The pouring port 154 is capped by the plug 155 in a usual state. In a state where the liquid accommodating body 30 is mounted in the holder 153 (refer to FIG. 9), the supply port portion 168 illustrated in FIG. 10 is connected to an upstream side end portion of the liquid supply tube 42 through a flow path (not shown) in the flow path forming member 151. A downstream side end portion of the liquid supply tube 42 is connected to a base end portion of the introduction needle portion 164. Therefore, the upstream side liquid supply flow path 166 includes a flow path formed in the flow path forming member 151 and a flow path of the liquid supply tube 42 and the introduction needle portion 164. Note that, in the liquid accommodating chamber 157, a guide plate 170 that defines a liquid accommodating region, in which the height of the liquid surface is locally high, is provided in the vicinity of the supply port portion 168. Therefore, if the height of the surface of liquid accommodated in the liquid accommodating chamber 157 is not lower than the lower end of the guide plate 170, the height of the surface of liquid in the liquid accommodating region defined by the guide plate 170 is maintained to be higher than that of the supply port portion 168. Therefore, liquid can be supplied through the supply port portion 168 until liquid in the liquid accommodating body 30 runs out.

In addition, as illustrated in FIG. 10, the base end portion of the supply needle portion 165 communicates with a liquid chamber 172 that communicates with a nozzle 171 of the liquid ejecting head 36 disposed below the carriage 34. Therefore, the downstream side liquid supply flow path 167 includes a flow path of the supply needle portion 165, the liquid chamber 172 of the liquid ejecting head 36, and a portion of the nozzle 171. A flow path extending from the supply port portion 168 of the liquid accommodating body 30 to the nozzle 171 of the liquid ejecting head 36 constitutes the liquid supply flow path 146 which is the target to be filled with liquid.

The upstream side liquid supply flow path 166 is provided with an opening/closing valve 173 and a supply pump 174 which are arranged in this order from the upstream side. When the supply pump 174 is driven, the supply pump 174 pressure-feeds liquid in a supply direction so that liquid is fed to the liquid ejecting head 36 via the intermediate storage body 145 from the liquid accommodating body 30 side. When the supply pump 174 is in a stopped state, the supply pump 174 can transition into a released state in which the supply pump 174 communicates with the upstream side liquid supply flow path 166 at both ends thereof. Note that, as the supply pump 174, a rotary pump such as a tube pump or a reciprocating pump such as a diaphragm pump can be used.

As illustrated in FIG. 10, a maintenance device 175 that performs maintenance of the liquid ejecting head 36 is disposed at a position corresponding to a home position HP (refer to FIG. 9) in the housing 14 of the liquid ejecting apparatus 12. The maintenance device 175 includes a cap 176 that can be relatively moved in such a direction that the cap 176 can approach the liquid ejecting head 36 and can be separated from the liquid ejecting head 36, a flow path 177 that is connected to a lower portion of the cap 176, and a suction pump 178 that is driven to suction air in the cap 176 via the flow path 177. When the suction pump 178 is in a stopped state, the suction pump 178 can transition into a released state in which the flow path 177 communicates with the atmosphere. In addition, a direction switching valve 179 is provided between the suction pump 178 and the cap 176 in the flow path 177. The direction switching valve 179 switches a direction in which the direction switching valve 179 is connected to the suction pump 178 between a direction toward the cap 176 and a direction toward a gas flow path 180. One end of the gas flow path 180, of which the other end is connected to the direction switching valve 179 is connected to the atmosphere communication hole 169 of the liquid accommodating body 30 via the flow path in the flow path forming member 151. In addition, an atmosphere opening valve 181 is provided in the middle of the gas flow path 180.

The position of the direction switching valve 179 is switched between a maintenance position at which a direction toward the cap 176 is selected as the connection direction and a gas flow path selecting position at which a direction toward the gas flow path 180 is selected as the connection direction. The position of the atmosphere opening valve 181 is switched between an opened-to-atmosphere position at which the gas flow path 180 is opened to the atmosphere and a non-opened position at which the gas flow path 180 is not opened to the atmosphere. The opening/closing valve 173, the direction switching valve 179, the atmosphere opening valve 181, the supply pump 174, and the suction pump 178 are controlled by the controller 50 illustrated in FIG. 9. Note that, a power source of a relative moving mechanism (not shown) which relatively moves the cap 176 and the liquid ejecting head 36 in such a direction that the cap 176 and the liquid ejecting head 36 can approach each other and the cap 176 and the liquid ejecting head 36 can be separated from each other, is also controlled by the controller 50. The relative moving mechanism is configured of an elevating mechanism of the cap 176 or an elevating mechanism of the carriage 34.

Next, the configuration of the intermediate storage body 145 will be described in detail with reference to FIG. 10. As illustrated in FIG. 10, the intermediate storage body 145 includes a supply chamber 182 and a pressure chamber 183 as the intermediate storage portion 161. The pressure adjustment mechanism 163 is disposed between the supply chamber 182 and the pressure chamber 183. The pressure adjustment mechanism 163 has a function of adjusting the pressure of liquid in the pressure chamber 183, which determines the back pressure of the liquid ejecting head 36, to a set pressure within a predetermined range.

The intermediate storage body 145 includes a first diaphragm 184 which is provided on one outer surface of the supply chamber 182 and the first diaphragm 184 is displaced corresponding to a difference between the external pressure (atmospheric pressure) and the inner pressure (pressure of liquid). In addition, the intermediate storage body 145 includes a second diaphragm 185 which is provided on one outer surface of the pressure chamber 183 and which is opposite to the first diaphragm 184 and the second diaphragm 185 is displaced corresponding to a difference between the external pressure (atmospheric pressure) and the inner pressure (pressure of liquid).

The intermediate storage body 145 includes an inlet portion 186 which is provided in an end portion of the supply chamber 182 and to which the introduction needle portion 164 is connected. The supply chamber 182 communicates with the upstream side liquid supply flow path 166 in a state where the inlet portion 186 and the introduction needle portion 164 are connected to each other. In addition, The intermediate storage body 145 includes an outlet portion 187 which is provided in an end portion of the pressure chamber 183 and to which the supply needle portion 165 is connected. The pressure chamber 183 communicates with the downstream side liquid supply flow path 167 including the liquid chamber 172 in the liquid ejecting head 36 in a state where the supply needle portion 165 is connected to the outlet portion 187.

Next, the configuration of the pressure adjustment mechanism 163 will be described with reference to FIG. 10. The pressure adjustment mechanism 163 is configured of, for example, a differential pressure type pressure adjustment valve (for example, pressure reducing valve) provided between the supply chamber 182 and the pressure chamber 183. The pressure adjustment mechanism 163 includes a valve body 189 of which a shaft portion 190 is inserted into a communication hole 188 formed in a partition wall 145*a* between the supply chamber 182 and the pressure chamber 183 and a spring 191 that urges the valve body 189 in a direction from the supply chamber 182 to the pressure chamber 183. A tip end of the shaft portion 190 of the valve body 189 which protrudes into the pressure chamber 183 abuts onto an abutting member 192 that is fixed to an inner wall of the second diaphragm 185. In addition, a filter 193 is provided between the supply chamber 182 and the pressure chamber 183. When the pressure adjustment mechanism 163 is opened, liquid passes through the filter 193 so that foreign substances such as air bubbles are removed from the liquid.

The valve body 189 moves corresponding to an urging force from the spring 191, a difference between the pressure of liquid and the atmospheric pressure which are applied to the both surfaces of the second diaphragm 185, or the like. When the pressure of liquid in the pressure chamber 183 becomes lower than the set pressure since liquid is consumed in the liquid ejecting head 36, the valve body 189 of the pressure adjustment mechanism 163 moves to a valve opening side (left side in FIG. 10) against the urging force from the spring 191 so that the valve body 189 is opened. When liquid is supplied to the pressure chamber 183 from the supply chamber 182 via the communication hole 188 with the valve body 189 being opened and the pressure of liquid in the pressure chamber 183 reaches the set pressure, the valve body 189 moves to a valve closing side (right side in FIG. 10) and the valve body 189 is closed.

In addition, before the intermediate storage body 145 is connected to the intermediate storage body connection portion 162, the intermediate storage portion 161 in the intermediate storage body 145 is filled with liquid in advance such that the pressure in the intermediate storage portion 161 is higher than the pressure in a space outside the intermediate storage portion 161. The supply chamber 182 is in a state where the first diaphragm 184 swells outwards due to the liquid filling the supply chamber 182. The liquid in the supply chamber 182 is in a state of being pressurized by a pressure higher than the atmospheric pressure in a space outside the intermediate storage portion 161 due to an elastic restoring force of the first diaphragm 184 swelling outwards. In addition, the pressure of liquid in the pressure chamber 183 is equal to the set pressure within a predetermined range or is higher than the set pressure since the amount of liquid filling the pressure chamber 183 is larger than the amount of liquid for achieving the set pressure. In addition, unlike the liquid accommodating body 30 which is a pouring type opened tank that is opened to the atmosphere, the intermediate storage body 145 is an air-tightly closed tank in which the intermediate storage portion 161 is filled with only liquid in a state of being not opened to the atmosphere.

In addition, a pressing member 195 that can press the outer surface corresponding to an abutting member 194 fixed to an inner wall of the first diaphragm 184 is preferably disposed at a position on the outside of the first diaphragm 184 as illustrated in FIG. 10. Liquid in the supply chamber 182 can be pressurized with the pressing member 195 pressing the supply chamber 182 from the outside. Particularly, in the present example, liquid in the supply chamber 182 can be pressurized with the pressing member 195 pressing the first diaphragm 184 from the outside even in a case where there is no elastic restoring force of the first diaphragm 184 in a direction in which the liquid in the supply chamber 182 is pressurized.

In addition, the liquid ejecting apparatus 12 includes a liquid flow mechanism in order to cause liquid stored in the intermediate storage portion 161 of the intermediate storage body 145 that is connected to the intermediate storage body connection portion 162 to flow into the upstream side liquid supply flow path 166. The number of main examples of the liquid flow mechanism is three. The first example of the liquid flow mechanism is a liquid flow mechanism (hydraulic head difference flow mechanism) that causes liquid to flow into the upstream side liquid supply flow path 166 by using a difference in height (difference in hydraulic head) with the intermediate storage body connection portion 162 being disposed above the upstream side liquid supply flow path 166 in the gravity direction.

The second example of the liquid flow mechanism is a pressurizing mechanism 196 that pressurizes liquid in the intermediate storage portion 161 of the intermediate storage body 145 that is connected to the intermediate storage body connection portion 162. The pressurizing mechanism 196 includes a first pressurizing mechanism in which liquid is stored in the intermediate storage portion 161 in a state where the liquid is pressurized with a pressure higher than the pressure in the external space and a second pressurizing mechanism that pressurizes (for example, presses) liquid in the intermediate storage portion 161 using an external force from the outside of the intermediate storage body 145. Note that, the first diaphragm 184 in FIG. 10 that is provided as an example of a flexible film that pressurizes liquid in the supply chamber 182 corresponds to an example of the first pressurizing mechanism and the pressing member 195 that can press the liquid in the supply chamber 182 using an external force from the outside corresponds to an example of the second pressurizing mechanism.

The third example of the liquid flow mechanism is a pressure reducing mechanism 197 that reduces the pressure in the upstream side liquid supply flow path 166. In the present example, the pressure reducing mechanism 197, which reduces the pressure in the liquid accommodating chamber 157 of the liquid accommodating body 30 so that the pressure in the upstream side liquid supply flow path 166 is reduced and liquid flows into the upstream side liquid supply flow path 166, is adopted. For example, the pressure in the liquid accommodating chamber 157 of the liquid accommodating body 30 is reduced by using a pump. Particularly, in the present example, the pressure in the liquid accommodating chamber 157 is reduced by using the suction pump 178 of the maintenance device 175. Specifically, the suction pump 178 is driven after the position of the direction switching valve 179 is switched to the gas flow path selecting position at which the suction pump 178 is connected to the gas flow path 180 and the position of atmosphere opening valve 181 is switched to a not-opened-to-atmosphere position so that air in the liquid accommodating chamber 157 is suctioned via the gas flow path 180 and the pressure in the liquid accommodating chamber 157 is reduced.

Next, the operation of the liquid ejecting apparatus 12 will be described. First, a liquid filling operation (initial filling operation) which is performed when a user uses the liquid ejecting apparatus 12 for the first time will be described with reference to FIGS. 10 to 14. Although a plurality of liquid supply flow paths 146, which are connected to the plurality of liquid accommodating bodies 30 and in which different kinds of liquid (for example, different in color) flow, are filled with liquid, liquid filling operations for the plurality of liquid supply flow paths 146 are basically the same as each other. Therefore, in the following description, a liquid filling operation for one liquid supply flow path 146 will be described. In addition, in FIGS. 11 to 14, a hashed region represents a region filled with liquid or the like.

When the user uses the liquid ejecting apparatus 12 for the first time, the liquid supply flow path 146 is not filled with liquid and the liquid supply flow path 146 is in an initial state of being filled with air. The user performs the initial filling operation of filling the liquid supply flow path 146 with liquid. First, the user opens the image reading device 13, which also functions as a lid of the housing 14 of the liquid ejecting apparatus 12, with a hinge 218 as a fulcrum until a predetermined openness is reached. As a result, the carriage 34 in the housing 14 and the intermediate storage body connection portion 162 protruding from the upper surface of the carriage 34 are exposed.

The user instructs the liquid ejecting apparatus 12 to perform a liquid filling operation by operating an operation unit 15 when the user performs the initial filling operation. When the controller 50 receives an instruction to perform the liquid filling operation based on an operation signal from the operation unit 15, a liquid filling preparing operation is performed. The controller 50 switches the position of the direction switching valve 179 to the opened-to-atmosphere selected position and switches the position of the atmosphere opening valve 181 to the not-opened-to-atmosphere position. As a result, the suction pump 178 communicates with the liquid accommodating chamber 157 through the gas flow path 180. In addition, the controller 50 causes the opening/closing valve 173 to enter an opened state and the supply pump 174 to enter the released state. As a result, the introduction needle portion 164 of the intermediate storage body connection portion 162 communicates with the liquid accommodating chamber 157 through the upstream side liquid supply flow path 166. Furthermore, the controller 50 drives the power source of the relative moving mechanism so that the cap 176 and the liquid ejecting head 36 are relatively moved in such a direction that the cap 176 and the liquid ejecting head 36 approach each other and a closed space surrounded by the cap 176 and the liquid ejecting head 36 is formed. At this time, the cap 176 is in a capping position at which the cap 176 can receive liquid leaking from the nozzle 171 of the liquid ejecting head 36. In addition, a space in the cap 176 is not opened to the atmosphere.

In addition, before the intermediate storage body 145 is connected to the intermediate storage body connection portion 162, as illustrated in FIG. 10, a volume of liquid is accommodated in the intermediate storage body 145 such that the first diaphragm 184 swells outwards and the liquid in the supply chamber 182 is pressurized by a pressure higher than the atmospheric pressure due to an elastic restoring force of the first diaphragm 184, which functions as the pressurizing mechanism 196. In addition, in a case where the pressure of liquid stored in the pressure chamber 183 is equal to the set pressure or is higher than the set pressure, the pressure adjustment mechanism 163 is opened. In addition, both of the inlet portion 186 and the outlet portion 187 of the intermediate storage body 145 are closed by an elastic member or a valve mechanism (not shown) before being connected to the intermediate storage body connection portion 162.

The user connects the intermediate storage body 145 to the intermediate storage body connection portion 162. As a result of the connection, the introduction needle portion 164 and the supply needle portion 165 are respectively inserted into the inlet portion 186 and the outlet portion 187 of the intermediate storage body 145 so that the supply chamber 182 communicates with the upstream side liquid supply flow path 166 through the introduction needle portion 164 and the pressure chamber 183 communicates with the downstream side liquid supply flow path 167 through the outlet portion 187.

Figure 11:
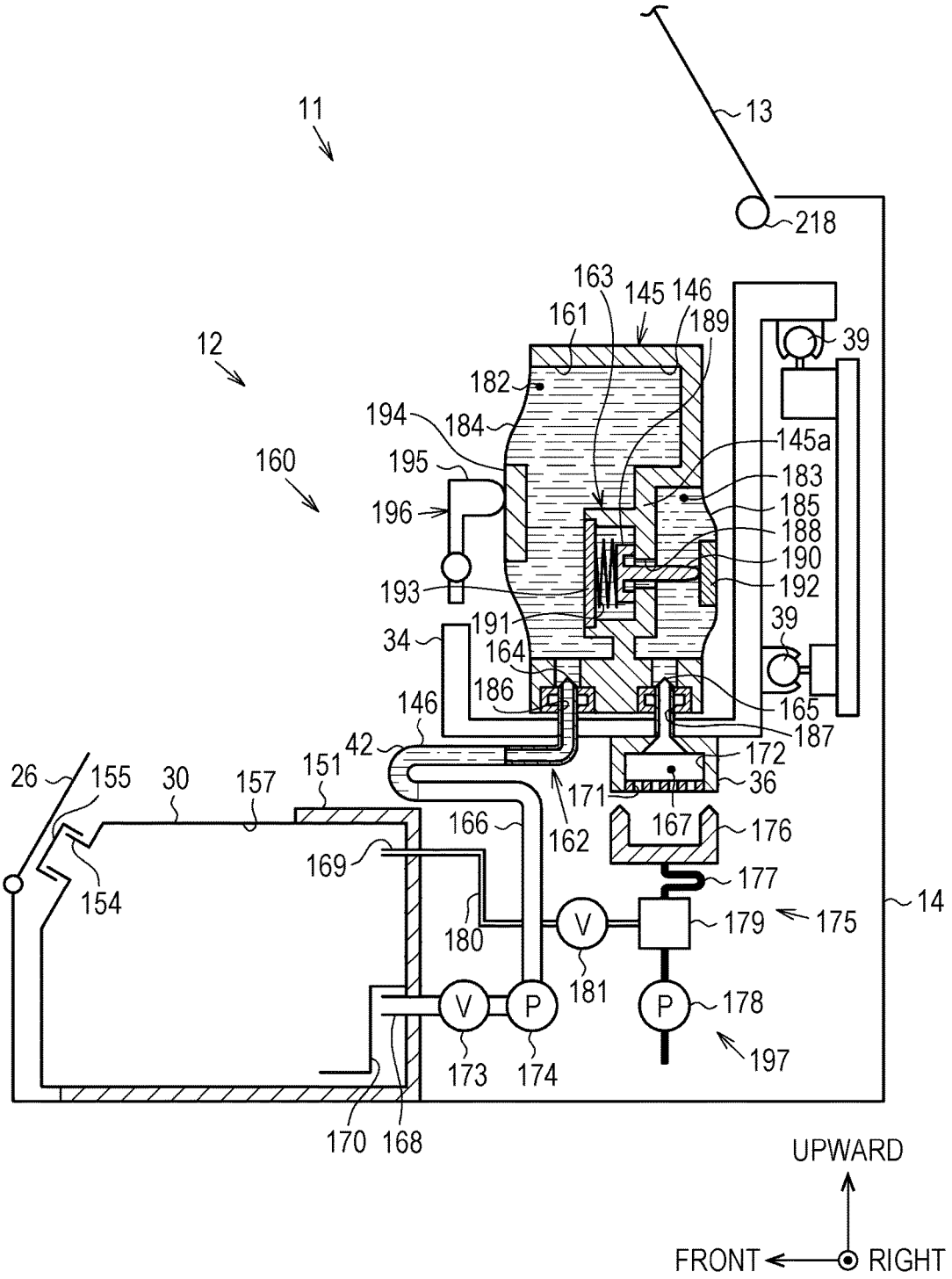
FIG. 11 is a schematic sectional view illustrating the procedure of a liquid filling method with respect to the liquid ejecting apparatus according to the second embodiment.

In this state in which the intermediate storage body 145 and the intermediate storage body connection portion 162 are connected to each other, the intermediate storage body 145 is disposed above the upstream side liquid supply flow path 166 in the gravity direction. As a result, as illustrated in FIG. 11, liquid stored in the supply chamber 182 of the intermediate storage body 145 that is connected to the intermediate storage body connection portion 162 is caused to flow in the upstream side liquid supply flow path 166 in a direction toward the liquid accommodating body 30 by a liquid flow mechanism that uses a difference in hydraulic head (hydraulic head difference flow mechanism).

In addition, since liquid stored in the supply chamber 182 is pressurized by a pressure higher than the atmospheric pressure due to a liquid flow mechanism (first pressurizing mechanism) which uses an elastic restoring force of the first diaphragm 184, the pressurizing force causes the liquid stored in the supply chamber 182 to flow toward the liquid accommodating body 30 through the introduction needle portion 164 while flowing in the upstream side liquid supply flow path 166.

In addition, when the liquid flows into the upstream side liquid supply flow path 166 and the amount of liquid in the intermediate storage portion 161 decreases, the pressure in the intermediate storage portion 161 becomes a negative pressure and liquid stops to flow. At this time, even if the pressure of liquid in the supply chamber 182 becomes a negative pressure, the pressure adjustment mechanism 163 is not opened since the pressure-receiving area of the valve body 189 on the supply chamber 182 side is relatively small. If the pressure adjustment mechanism 163 is opened, the pressure of liquid in the pressure chamber 183 may become higher than the set pressure (negative pressure) and liquid may leak from the nozzle 171 of the liquid ejecting head 36. However, since the cap 176 is disposed at the capping position at which the cap 176 is close to the liquid ejecting head 36, liquid leaking from the nozzle 171 is received by the cap 176.

In addition, the controller 50 detects that an operation of filling the upstream side liquid supply flow path 166 with liquid is started and the operation of filling the upstream side liquid supply flow path 166 with liquid is not yet finished on the basis of a sensor (not shown) that detects the pressure of liquid in the upstream side liquid supply flow path 166 or detects completion of connection between the intermediate storage body 145 and the intermediate storage body connection portion 162 or a timer (not shown). Thereafter, the controller 50 drives an actuator (not shown) such that the pressing member 195 is displaced in such a direction that the pressing member 195 can press the first diaphragm 184 from the outside. When the pressing member 195 presses the first diaphragm 184 from the outside, liquid stored in the supply chamber 182 is pressurized. The liquid pressurized by the pressurizing mechanism 196 that uses the pressing member 195 flows from the supply chamber 182 toward the liquid accommodating body 30 through the introduction needle portion 164 while flowing in the upstream side liquid supply flow path 166.

Furthermore, the liquid in the upstream side liquid supply flow path 166 is caused to flow from the supply chamber 182 toward the liquid accommodating body 30 through the introduction needle portion 164 while flowing in the upstream side liquid supply flow path 166 with the pressure reducing mechanism 197 reducing the pressure in the upstream side liquid supply flow path 166. The pressure reducing mechanism 197 in the second embodiment reduces the pressure in the liquid accommodating chamber 157 of the liquid accommodating body 30 so that the pressure in the upstream side liquid supply flow path 166 is reduced. Specifically, when the controller 50 receives instruction to perform the liquid filling operation from the operation unit 15 operated by the user or a sensor or the like detects connection between the intermediate storage body 145 and the intermediate storage body connection portion 162, the controller 50 drives the suction pump 178 of the maintenance device 175. As a result, a suction force from the suction pump 178 reaches the liquid accommodating chamber 157 through the gas flow path 180 and gas (air) in the liquid accommodating chamber 157 is suctioned so that the pressure in the liquid accommodating chamber 157 is reduced. As a result of reduction in pressure in the liquid accommodating chamber 157, the pressure in the upstream side liquid supply flow path 166 that communicates with the liquid accommodating chamber 157 is also reduced and liquid stored in the supply chamber 182 flows toward the liquid accommodating chamber 157 through the introduction needle portion 164 while flowing in the upstream side liquid supply flow path 166.

In this manner, air that is initially present in the upstream side liquid supply flow path 166 is discharged to the liquid accommodating body 30 side and the upstream side liquid supply flow path 166 is filled with liquid by the liquid flow mechanism. At this time, a hydraulic head difference filling operation is performed by the hydraulic head difference flow mechanism with the intermediate storage body 145 connected to the intermediate storage body connection portion 162 being positioned above the upstream side liquid supply flow path 166 in the gravity direction and liquid in the intermediate storage portion 161 is efficiently pressurized by the pressurizing mechanism 196. As a result, the amount of liquid flowing in the upstream side liquid supply flow path 166 (amount of flowing liquid per unit time) becomes large in an efficient manner. In addition, the pressure in the upstream side liquid supply flow path 166 can be reduced by the pressure reducing mechanism 197 and thus the amount of liquid flowing in the upstream side liquid supply flow path 166 becomes large in an efficient manner.

Figure 12:
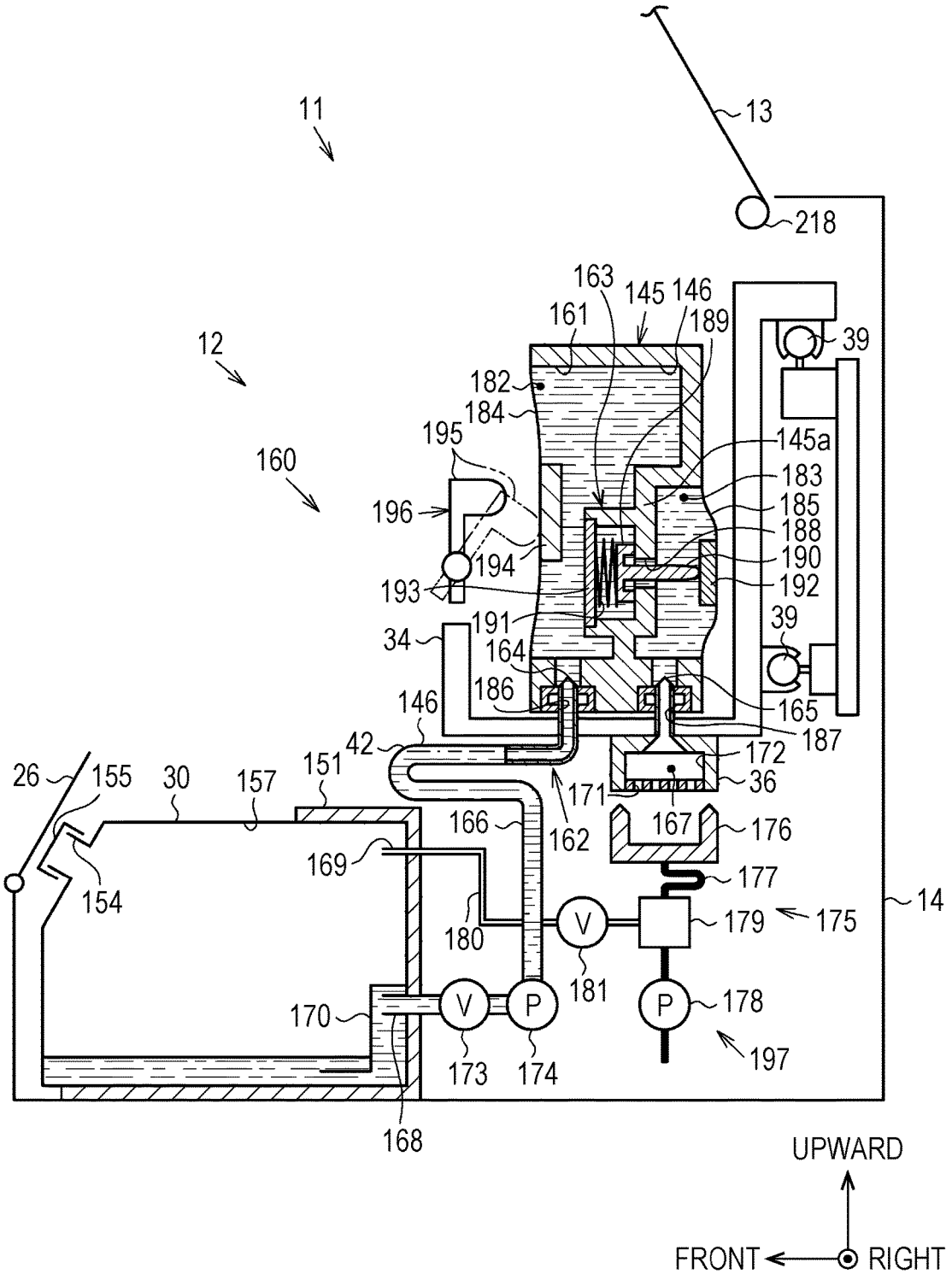
FIG. 12 is a schematic sectional view illustrating the procedure of the liquid filling method according to the second embodiment.

Due to a first filling operation of filling the upstream side liquid supply flow path 166 with liquid, as illustrated in FIG. 12, a portion of liquid that flows from the supply chamber 182 toward the liquid accommodating body 30 while flowing in the upstream side liquid supply flow path 166 flows into the liquid accommodating chamber 157 from the supply port portion 168. For example, after a region defined by the guide plate 170 is filled with liquid, the liquid flows up to a position above the lower end position of the guide plate 170 in the gravity direction. In this manner, the first filling operation is finished.

Figure 13:
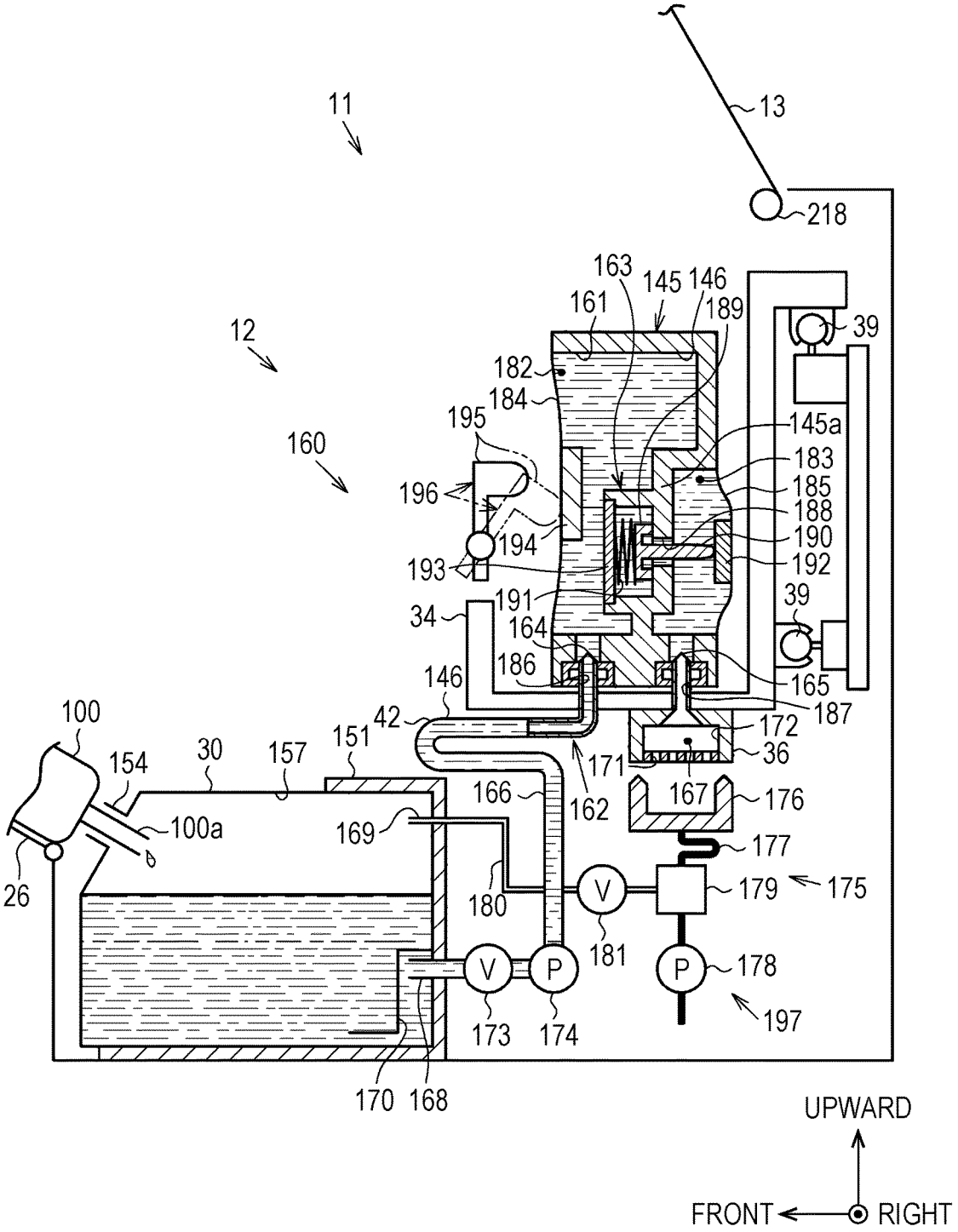
FIG. 13 is a schematic sectional view illustrating the procedure of the liquid filling method according to the second embodiment.
Figure 14:
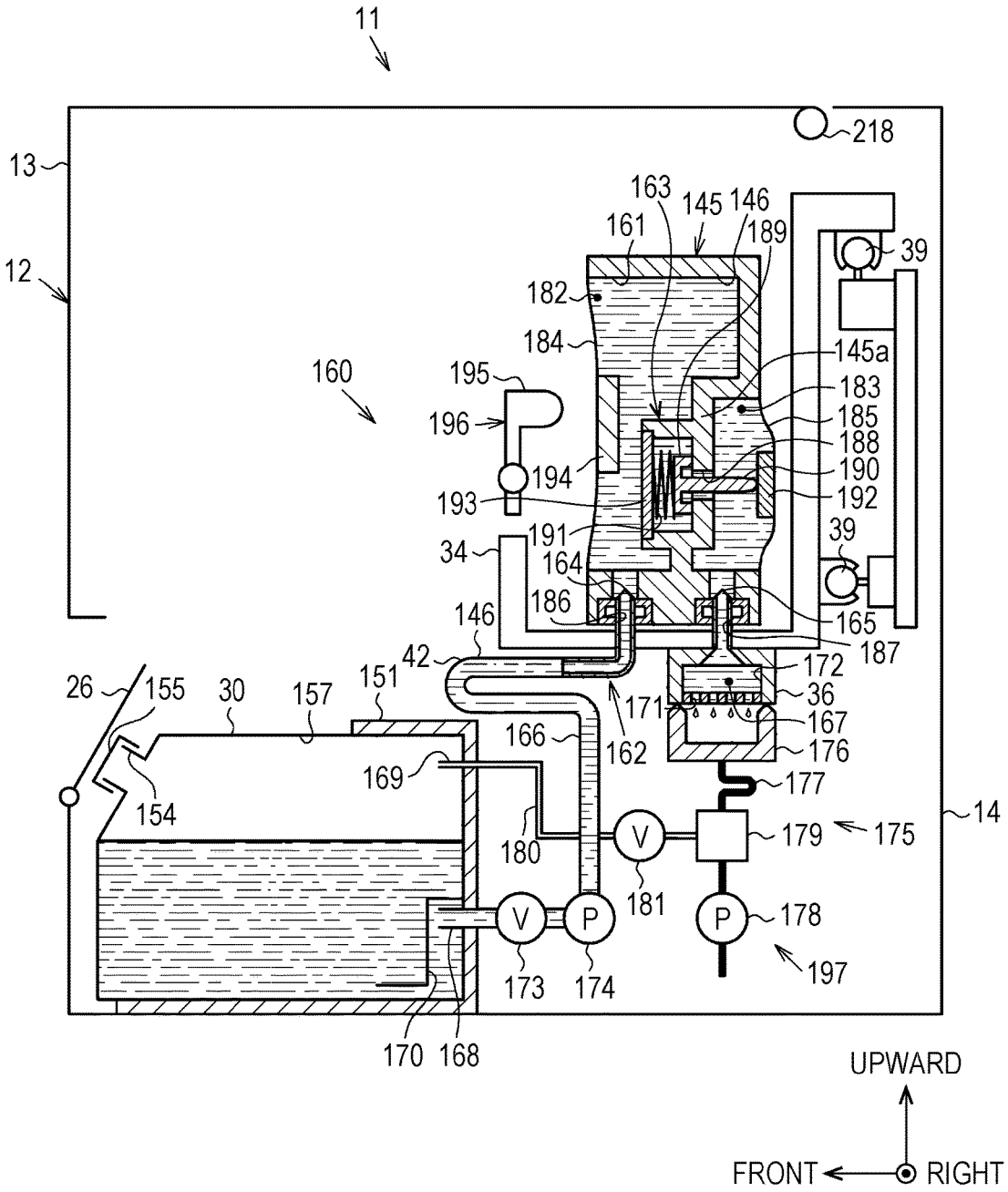
FIG. 14 is a schematic sectional view illustrating the procedure of the liquid filling method according to the second embodiment.

Next, as illustrated in FIG. 13, the user performs an pouring operation of pouring liquid into the liquid accommodating body 30. After rotating the covering member 26 from the closing position to the opening position and removing the plug 155 from the exposed pouring port 154, the user inserts the spout portion 100*a* of the liquid bottle 100 into the pouring port 154 and pours liquid into the liquid accommodating chamber 157 from the liquid bottle 100. At this time, the user mounts the liquid bottle 100 on the rear surface of the covering member 26 which is held in an opening posture that is parallel to an axial direction of the pouring port 154 with the liquid bottle 100 being engaged with the recessed groove 28*a*. Since the liquid bottle 100 is held in an oblique posture with the spout portion 100*a* being inserted into the pouring port 154, even if the user does not hold the liquid bottle 100 with a hand, liquid is poured into the liquid accommodating body 30 from the liquid bottle 100.

At the time of the pouring operation, the user checks the change in height of the surface of liquid in the liquid accommodating body 30 via the visual recognition portion 68 (refer to FIG. 1) and when the height of the surface of liquid reaches the upper limit denoting portion 69 (refer to FIG. 1), the user stops the pouring of liquid and closes the pouring port 154 with the plug 155. Then, the user closes the covering member 26. In this manner, the liquid pouring operation is finished. Note that, the amount of liquid poured into the liquid accommodating body 30 may be only an amount necessary for a second filling operation which is performed thereafter. After the liquid pouring operation is finished in this manner, the user operates the operation unit 15 to notify the liquid ejecting apparatus 12 that the liquid pouring operation has been finished. Note that, if an amount of liquid necessary for the second filling operation is secured in the liquid accommodating chamber 157 at a time when the first filling operation has been finished, the liquid pouring operation can be omitted.

When the controller 50 is notified that the liquid pouring operation has been finished, the controller 50 switches the position of the direction switching valve 179 to the maintenance position and switches the position of the atmosphere opening valve 181 to the opened-to-atmosphere position. As a result, the cap 176 that is in a state of being not opened to the atmosphere and the suction pump 178 communicate with each other and the liquid accommodating chamber 157 is opened to the atmosphere. Note that, in a case where there is no possibility that liquid may leak from the nozzle 171 of the liquid ejecting head 36 at the time of the first filling operation, the cap 176 may be disposed at a withdrawal position at which the cap 176 is separated from the liquid ejecting head 36. In this case, the controller 50 drives the power source of the relative moving mechanism after the first filling operation is finished or after the liquid pouring operation is finished so that the cap 176 moves to the capping position and a closed space surrounded by the cap 176 and the liquid ejecting head 36 is formed.

Then, the controller 50 drives the suction pump 178 such that the pressure in the closed space that communicates with the nozzle 171 becomes a negative pressure and liquid stored in the pressure chamber 183 flows toward the nozzle 171 while flowing in the downstream side liquid supply flow path 167 due to a suction force which is generated due to the negative pressure. At this time, since the amount of liquid stored in the pressure chamber 183 decreases and the pressure of liquid in the pressure chamber 183 decreases, the second diaphragm 185 is displaced in such a direction that the volume of the pressure chamber 183 decreases due to a difference between the atmospheric pressure in a space on the outside of the second diaphragm 185 and the pressure of liquid in a space on the inside of the second diaphragm 185 and when the pressure of the liquid becomes lower than the set pressure, the pressure adjustment mechanism 163 is opened and liquid flows into the pressure chamber 183 from the supply chamber 182. In this manner, liquid stored in the pressure chamber 183 flows toward the downstream side while flowing in the downstream side liquid supply flow path 167 due to a suction force from the nozzle 171 and gas and liquid are suctioned and discharged to a space in the cap 176 via the nozzle 171. Then, the suction pump 178 is stopped and when the pressure of liquid in the pressure chamber 183 reaches the set pressure, the pressure adjustment mechanism 163 is closed. In this manner, the downstream side liquid supply flow path 167 is filled with liquid through the second filling operation.

When the second filling operation (second filling process) is finished in this manner, the initial filling operation is finished. Next, the controller 50 drives the relative moving mechanism so that the cap 176 is disposed at a flushing position at which the cap 176 is slightly separated from the liquid ejecting head 36. Then, the controller 50 drives the maintenance device 175 so that a flushing operation of wiping a nozzle opening surface of the liquid ejecting head 36 and ejecting liquid droplets toward the cap 176 through all of nozzles 171 of the liquid ejecting head 36 is performed. As a result, a meniscus having an appropriate shape is formed on liquid in the nozzle 171 and thus liquid can be ejected toward a medium M through the nozzle 171 in a normal state.

In the second embodiment, the operation of filling the upstream side liquid supply flow path 166 with liquid and the operation of filling the downstream side liquid supply flow path 167 with liquid are performed separately. Therefore, in a case where liquid is supplied from the intermediate storage body 145, it is possible to fill the upstream side liquid supply flow path 166 with liquid in a short time and in a stable manner in comparison with a case where liquid is supplied to both of the upstream side liquid supply flow path 166 and the downstream side liquid supply flow path 167 at the same time.

Here, in a case where a liquid filling operation of only suctioning and discharging liquid via a nozzle as in the liquid ejecting apparatus in the related art, which is described in JP-A-2006-137181, is adopted, since air present on the liquid accommodating body 30 side also moves along the liquid supply flow path 146 by a relatively long distance until reaching the nozzle, air bubbles are relatively likely to remain in the liquid supply flow path 146. In addition, since the liquid accommodating body 30 is an opened liquid accommodating body in which a liquid region and an air region exist, when liquid is poured into the liquid accommodating body 30 from the liquid bottle 100, air bubbles are likely to be generated in liquid with air being involved with the pouring of liquid. In this case, at the time of the liquid filling operation, the liquid supply flow path is filled with liquid from the liquid accommodating body in which air bubbles are likely to be present and air bubbles are likely to remain on liquid filling the liquid supply flow path for this reason as well. In this case, liquid ejecting failure caused by air bubbles is likely to occur.

On the contrary, in the second embodiment, at the time of the liquid filling operation, air in the upstream side liquid supply flow path 166 which is a portion of the liquid supply flow path 146 positioned on the upstream side of the intermediate storage body connection portion 162 is discharged to the liquid accommodating body 30 and air in the downstream side liquid supply flow path 167 is discharged via the nozzle 171 of the liquid ejecting head 36. Therefore, the movement distance of air discharged through the liquid supply flow path 146 can be relatively short and thus air (air bubbles) are not likely to remain in the liquid supply flow path 146 after the liquid filling operation. In addition, since a liquid supply source used in the liquid filling operation is the air-tightly closed intermediate storage body 145 in which only liquid is stored, the liquid supply flow path 146 is filled with liquid from the intermediate storage body 145 in which the number of air bubbles is extremely small.

Thereafter, liquid is supplied from the liquid accommodating body 30 to the supply chamber 182 of the intermediate storage body 145 through the upstream side liquid supply flow path 166 with the supply pump 174 being driven in a state where the opening/closing valve 173 is open so that a predetermined amount of liquid is stored in the supply chamber 182. When a liquid ejecting operation is started, liquid is ejected toward the medium M through the nozzle 171 of the liquid ejecting head 36 and liquid is consumed. When the pressure of liquid in the pressure chamber 183 becomes lower than the set pressure with the consumption of liquid, the pressure adjustment mechanism 163 is opened and liquid is supplied from the supply chamber 182 to the pressure chamber 183 through the communication hole 188. Then, when the pressure of liquid in the pressure chamber 183 reaches the set pressure, the pressure adjustment mechanism 163 is opened. In this manner, the pressure of liquid in the pressure chamber 183, which determines the back pressure of the liquid ejecting head 36, is maintained at the set pressure. Accordingly, a meniscus having an appropriate shape is formed on liquid in the nozzle 171 and thus it is possible to eject normal liquid toward the medium M through the nozzle 171. As a result, it is possible to maintain a high quality of a liquid landed-object such as a printed matter which is formed when liquid ejected from the liquid ejecting head 36 lands on the medium M. In addition, since liquid in the liquid supply flow path 146 contains a relatively small number of air bubbles at a time immediately after the initial filling operation is finished, the frequency of liquid ejecting failure caused by air bubbles decreases. For this reason also, it is possible to form a high-quality liquid-landed object.

As described above, according to the liquid ejecting apparatus in the above-described second embodiment, the following effects can be achieved.

(8) The liquid ejecting head 36 that ejects liquid and the liquid supply flow path 146 that connects the liquid accommodating body 30 and the liquid ejecting head 36 such that liquid accommodated in the liquid accommodating body 30 can be supplied to the liquid ejecting head 36 are provided. The liquid supply flow path 146 that includes the intermediate storage body connection portion 162 which is positioned between the liquid accommodating body 30 and the liquid ejecting head 36 and which can be connected to the intermediate storage body 145 including the intermediate storage portion 161 in which the liquid can be stored is provided. The liquid filling method of filling the liquid ejecting apparatus 12 with liquid includes causing liquid to flow from the intermediate storage body connection portion 162 into the upstream side liquid supply flow path 166, which is a portion of the liquid supply flow path 146 positioned on the upstream side of the intermediate storage body connection portion 162, so that the upstream side liquid supply flow path 166 is filled with liquid. Therefore, air that is initially present in the upstream side liquid supply flow path 166 can be discharged to the upstream side when filling the upstream side liquid supply flow path 166 with liquid and thus it is possible to decrease the amount of air discharged to the outside via a space in the liquid ejecting head 36. Accordingly, it is possible to efficiently perform the filling operation. In this case, even if the liquid accommodating body 30 is a pouring type opened tank, it is possible to efficiently fill the liquid supply flow path 146 with liquid while suppressing air entering thereinto.

(9) The intermediate storage body 145 in which the intermediate storage portion 161 is filled with the liquid in advance is connected to the intermediate storage body connection portion 162 so that the upstream side liquid supply flow path 166 is filled with the liquid in the intermediate storage portion 161. Therefore, it is easy to cause liquid to flow into the upstream side liquid supply flow path 166 from the intermediate storage body connection portion 162 side so that the upstream side liquid supply flow path 166 is filled with liquid.

(10) The intermediate storage portion 161 in the intermediate storage body 145 is filled with liquid in advance such that the pressure in the intermediate storage portion 161 is higher than the pressure in a space on the outside of the intermediate storage portion 161. Therefore, since the intermediate storage body 145 in which liquid in the intermediate storage portion 161 is pressurized is used, it is possible to increase the amount of liquid flowing in the upstream side liquid supply flow path 166 (amount of flowing liquid per unit time) and thus it is possible to efficiently perform the filling operation.

(11) Liquid is caused to flow from the intermediate storage body connection portion 162 into the downstream side liquid supply flow path 167, which is a portion of the liquid supply flow path 146 positioned on the downstream side of the intermediate storage body connection portion 162, so that the downstream side liquid supply flow path 167 is filled with liquid. Therefore, it is easy to fill the downstream side liquid supply flow path 167 with liquid so that the liquid supply flow path 146 is filled with liquid.

(12) The liquid ejecting apparatus 12 includes the liquid accommodating body 30 and the liquid ejecting head 36 that ejects liquid. The liquid accommodating body 30 includes the liquid accommodating chamber 157 which accommodates liquid, the pouring port 154 through which liquid is poured into the liquid accommodating chamber 157 from the outside, and the atmosphere communication hole 169 through which the liquid accommodating chamber 157 communicates with the atmosphere. In addition, in the liquid ejecting apparatus 12, the liquid supply flow path 146 that connects the liquid accommodating body 30 and the liquid ejecting head 36 such that liquid accommodated in the liquid accommodating body 30 can be supplied to the liquid ejecting head 36 includes the intermediate storage body connection portion 162 that is positioned between the liquid accommodating body 30 and the liquid ejecting head 36 and that can be connected to the intermediate storage body 145 including the intermediate storage portion 161 in which the liquid can be stored. Furthermore, the liquid ejecting apparatus 12 includes the liquid flow mechanism that causes liquid stored in the intermediate storage portion 161 of the intermediate storage body 145 connected to the intermediate storage body connection portion 162 to flow into the upstream side liquid supply flow path 166 which is a portion of the liquid supply flow path 146 positioned on the upstream side of the intermediate storage body connection portion 162. Therefore, air that is initially present in the upstream side liquid supply flow path 166 can be discharged to the upstream side when filling the upstream side liquid supply flow path 166 with liquid and thus it is possible to decrease the amount of air discharged to the outside via a space in the liquid ejecting head 36. Accordingly, it is possible to efficiently perform the filling operation.

(13) As the liquid flow mechanism, the intermediate storage body connection portion 162 is provided above the upstream side liquid supply flow path 166 in the gravity direction. Therefore, it is possible to cause liquid in the intermediate storage portion 161 to flow into the upstream side liquid supply flow path 166 by using a difference in height (difference in hydraulic head) between liquid in the intermediate storage portion 161 and the upstream side liquid supply flow path 166.

(14) As the liquid flow mechanism, the pressurizing mechanism 196 that pressurizes liquid in the intermediate storage portion 161 of the intermediate storage body 145 connected to the intermediate storage body connection portion 162 is provided. Therefore, it is possible to increase the amount of liquid flowing in the upstream side liquid supply flow path 166 (amount of flowing liquid per unit time) by pressurizing the liquid in the intermediate storage portion 161 and thus it is possible to efficiently perform the filling operation. In addition, as the pressurizing mechanism, the pressurizing mechanism 196 includes the first pressurizing mechanism in which liquid is stored in the intermediate storage portion 161 in a state where the liquid is pressurized with a pressure higher than the pressure in the external space and the second pressurizing mechanism that pressurizes (for example, presses) liquid in the intermediate storage portion 161 using an external force from the outside of the intermediate storage body 145. Therefore, it is possible to efficiently pressurize liquid in the intermediate storage portion 161 and to increase the amount of liquid flowing in the upstream side liquid supply flow path 166 (amount of flowing liquid per unit time) in an efficient manner and thus it is possible to perform the filling operation more efficiently.

(15) As the liquid flow mechanism, the pressure reducing mechanism 197 that reduces the pressure in the upstream side liquid supply flow path 166 is provided. Therefore, it is possible to increase the amount of liquid flowing in the upstream side liquid supply flow path 166 (amount of flowing liquid per unit time) by reducing the pressure in the upstream side liquid supply flow path 166 and thus it is possible to efficiently perform the filling operation.

Liquid Ejecting Apparatus in Third Embodiment

Figure 15:
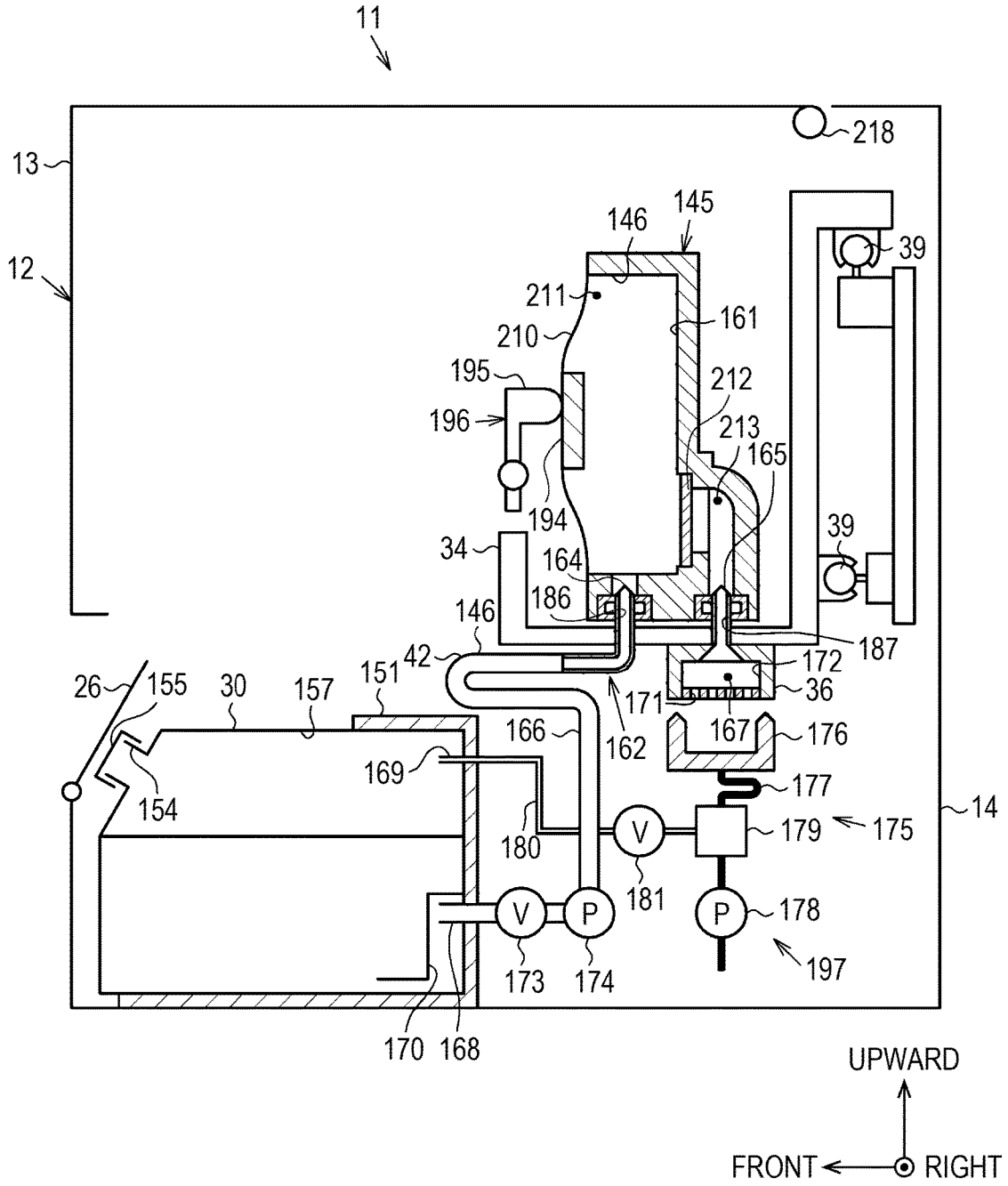
FIG. 15 is a schematic sectional view illustrating a liquid supply system in a liquid ejecting apparatus according to a third embodiment.

Next, a third embodiment will be described with reference to drawings. Unlike the intermediate storage body 145 in the second embodiment that includes the pressure adjustment mechanism 163, the intermediate storage body 145 in the third embodiment does not include the pressure adjustment mechanism 163 and only has a liquid storing function of storing liquid. The intermediate storage body 145 illustrated in FIG. 15 includes a liquid storage chamber 211 that includes a diaphragm 210 provided on one outer surface thereof. In the intermediate storage body 145, the inlet portion 186 is provided in an end portion of the liquid storage chamber 211 and the outlet portion 187 is provided in an end portion of a flow path 213 that is provided opposite to the liquid storage chamber 211 with a filter 212 being interposed therebetween. In an example illustrated in FIG. 15, the liquid storage chamber 211 in the intermediate storage body 145 and the flow path 213 constitute the intermediate storage portion 161 in which liquid is stored. The intermediate storage portion 161 in the intermediate storage body 145 is filled with liquid in advance such that the pressure in the intermediate storage portion 161 is higher than the pressure in a space outside the intermediate storage portion 161.

The liquid ejecting apparatus 12 includes the liquid flow mechanism in order to cause liquid stored in the intermediate storage portion 161 of the intermediate storage body 145 that is connected to the intermediate storage body connection portion 162 to flow into the upstream side liquid supply flow path 166. As with the liquid ejecting apparatus in the above-described second embodiment, the liquid flow mechanism includes the liquid flow mechanism (hydraulic head difference flow mechanism), the pressurizing mechanism 196 (first pressurizing mechanism and second pressurizing mechanism), and the pressure reducing mechanism 197.

Next, the operation of the liquid ejecting apparatus 12 will be described. The user instructs the liquid ejecting apparatus 12 to perform the liquid filling operation by operating an operation unit 15 when the user performs the initial filling operation. When the controller 50 receives an instruction to perform the liquid filling operation, a liquid filling preparing operation is performed. The controller 50 switches the position of the direction switching valve 179 to the opened-to-atmosphere selected position and switches the position of the atmosphere opening valve 181 to the opened-to-atmosphere position and causes the opening/closing valve 173 to enter an opened state and the supply pump 174 to enter the released state. In addition, the controller 50 causes the suction pump 178 to enter the released state and drives the power source of the relative moving mechanism so that the cap 176 is disposed at the capping position.

At the time of the initial filling operation, the user connects the intermediate storage body 145 to the intermediate storage body connection portion 162 (introduction needle portion 164 and supply needle portion 165) on the carriage 34 and liquid in the intermediate storage portion 161 is caused to flow to the upstream side liquid supply flow path 166 from the introduction needle portion 164 by the liquid flow mechanism. Therefore, while air that is initially present in the upstream side liquid supply flow path 166 is discharged into the liquid accommodating body 30 on the upstream side, the upstream side liquid supply flow path 166 is filled with liquid. At the same time, liquid in the intermediate storage portion 161 flows from the supply needle portion 165 to the downstream side liquid supply flow path 167 and air in the downstream side liquid supply flow path 167 is discharged through the nozzle 171 of the liquid ejecting head 36 such that an area up to the nozzle 171 is filled with liquid. As a result, it is possible to efficiently discharge gas (air) in the liquid supply flow path 146 at the time of the initial filling operation. In addition, in the third embodiment, the upstream side liquid supply flow path 166 and the downstream side liquid supply flow path 167 are started to be filled with liquid at the same time. Therefore, the total time taken for the liquid filling operation can be relatively short. In addition, in the liquid ejecting apparatus according to the third embodiment, the intermediate storage body 145 is configured to include the intermediate storage portion 161 which is configured of one chamber without including the pressure adjustment mechanism 163 unlike the liquid ejecting apparatus according to the second embodiment. However, it is possible to achieve the same effects as the above-described effects (1) to (8) in the liquid ejecting apparatus according to the first embodiment.

The components included in the liquid ejecting apparatus according to the first embodiment may be arbitrarily combined with the components included in the liquid ejecting apparatus according to the second embodiment or the components included in the liquid ejecting apparatus according to the third embodiment. For example, the configuration of the liquid accommodating body according to the first embodiment of the liquid ejecting apparatus according to the first embodiment may be added to the liquid ejecting apparatus according to the second embodiment.

In addition, the above-described embodiments may be modified as in the following modification examples. In addition, the components included in the above-described embodiments may be arbitrarily combined with combined components included in the following modification examples and the components included in the following modification examples may be combined with each other.

In a case where the pressure reducing mechanism 197 is not used as the liquid flow mechanism, it is preferable that the position of the atmosphere opening valve 181 be switched to the opened-to-atmosphere position so that the liquid accommodating body 30 is opened to the atmosphere. In this case, it is possible to suppress a decrease in efficiency in filling the upstream side liquid supply flow path 166 due to an increase in pressure in the liquid accommodating body 30 that is caused by inflow of liquid.

In the above-described embodiments, the opening/closing valve 173 provided in the upstream side liquid supply flow path 166 may be closed so that flow of liquid is stopped when the controller 50 detects that the operation of filling the upstream side liquid supply flow path 166 with liquid is finished by using a timer, a sensor provided in the liquid accommodating body 30, or the like. In this case, the liquid accommodating body may not be connected to the upstream end of the upstream side liquid supply flow path 166.

The upstream side liquid supply flow path 166 may be filled with liquid flowing from the intermediate storage body connection portion 162 in a state where an attachment for filling (liquid accommodating body dedicated to filling) is mounted instead of the liquid accommodating body 30. The attachment for filling includes a liquid recovering chamber which recovers liquid flowing out of the upstream end of the upstream side liquid supply flow path 166 at the time of liquid filling operation, an atmosphere opening communication portion through which the liquid recovering chamber is opened to the atmosphere, and a gas-liquid separation portion (for example, gas-liquid separating film) which separates gas from liquid when a mixture of the liquid and the gas passes through atmosphere opening communication portion from the liquid accommodating chamber and through which only gas passes. After the operation of filling the upstream side liquid supply flow path 166 with liquid is finished, the attachment for filling is removed and the liquid accommodating body 30 is mounted.

As the pressure reducing mechanism, a pressure reducing mechanism that reduces the pressure in at least a portion of the upstream side liquid supply flow path 166 by reversely driving the supply pump 174 in a direction opposite to a direction in which the supply pump 174 is driven at the time of liquid ejecting operation (time when liquid is supplied) may be used instead of the pressure reducing mechanism 197 that reduces the pressure in the liquid accommodating chamber 157 in the above-described embodiments. Specifically, the supply pump 174 is configured to be capable of being subject to a first driving operation (for example, forward driving operation) in which liquid is caused to flow in a first direction from the liquid accommodating body 30 toward the liquid ejecting head 36 and a second driving operation (for example, backward driving operation) in which liquid is caused to flow in a second direction from the intermediate storage portion 161 toward the liquid accommodating body 30. At the time of the liquid filling operation, the upstream side liquid supply flow path 166 enters a communication state with the opening/closing valve 173 being opened and the liquid accommodating chamber 157 is opened to the atmosphere with the atmosphere opening valve 181 being positioned at the opened-to-atmosphere position. In addition, at the time of the liquid filling operation, the supply pump 174 is subject to the second driving operation which is different from the first driving operation which is performed at the time of liquid ejecting operation and the pressure in a portion of the upstream side liquid supply flow path 166 which is on the downstream side of the supply pump 174 is reduced so that liquid in the intermediate storage portion 161 flows toward the upstream side and the upstream side liquid supply flow path 166 is filled with liquid. In this case, a portion of the upstream side liquid supply flow path 166 which is on the upstream side of the supply pump 174 is filled with liquid which is pressure-fed from the supply pump 174. Note that, it is preferable that the supply pump 174 can transition into the released state in which the supply pump 174 communicates with the upstream side liquid supply flow path 166 at both ends thereof in addition to being capable of being subject to the first driving operation and the second driving operation.

The liquid flow mechanism may include at least one of the hydraulic head difference flow mechanism, the pressurizing mechanism, and the pressure reducing mechanism. In addition, in a case where the pressurizing mechanism is provided, one of the first pressurizing mechanism and the second pressurizing mechanism may be provided. In addition, in a case where the pressure reducing mechanism is provided, at least one of a first pressure reducing mechanism that reduces the pressure in the liquid accommodating chamber 157 and a second pressure reducing mechanism that reversely drives the supply pump 174 may be provided. In a case where both of the first pressure reducing mechanism and the second pressure reducing mechanism are provided, it is possible to perform the operation of filling the upstream side liquid supply flow path 166 with liquid more efficiently.

In the above-described embodiments, the downstream side liquid supply flow path 167 may be filled with liquid earlier. In this case, the atmosphere opening valve 181 is blocked or the opening/closing valve 173 provided in the upstream side liquid supply flow path 166 is closed. According to this configuration, since a long time is taken for the entire liquid filling operation to be finished after the downstream side liquid supply flow path 167 is filled with liquid, it is possible to perform a stand-by process of delaying the start of printing until air bubbles that influence the printing are removed in parallel to the operation of filling the upstream side liquid supply flow path 166 with liquid. As a result, it is possible to shorten a stand-by time between a time when the liquid filling operation is finished and a time when the printing can be started.

The upstream side liquid supply flow path 166 and the downstream side liquid supply flow path 167 may be filled with liquid at the same time. In this case, it is preferable that the liquid ejecting head 36 be capped with the cap 176 and the suction pump 178 enter the released state while being not driven in the operation of filling the downstream side liquid supply flow path 167 with liquid. In addition, in a case where the intermediate storage portion 161 is the supply chamber 182 of the pressure adjustment mechanism 163, it is preferable that a valve be opened with the pressure chamber 183 being pressed or the like. In this case, it is possible to perform the entire liquid filling operation in a short time.

In a case where the intermediate storage portion 161 is not filled with liquid in advance, the intermediate storage portion 161 may be provided with a pouring port and the liquid filling operation may be performed by supplying liquid from the outside and pressure-feeding the liquid to the liquid supply flow path.

In a case where at least a portion of the intermediate storage portion 161 includes a flexible portion that is flexible, a method of pressurizing the flexible portion with an external force is not limited to a method in which the pressing member 195 presses the flexible portion. For example, a pressurizing chamber may be provided on the outside of the flexible portion (for example, first diaphragm 184) of the intermediate storage body 145 and gas (for example, air) may be supplied to the pressurizing chamber so that the pressure of air in the pressurizing chamber is applied to the flexible portion as an external force and the intermediate storage portion 161 is pressurized. In this case, a pressurizing mechanism that increases the pressure in the intermediate storage portion by applying an external force with pressurizing gas and a hydraulic head difference flow mechanism (hydraulic head difference filling operation) may be used together with each other.

The supply pump 174 may not be provided.

Before the intermediate storage body 145 is connected to the intermediate storage body connection portion 162, the supply chamber 182 may be filled with liquid in advance such that the pressure in the supply chamber 182 becomes higher than the pressure (atmospheric pressure) in a space on the outside of the intermediate storage portion 161 and the pressure chamber 183 may be filled with liquid in advance such that the pressure in the pressure chamber 183 becomes equal to or lower than the pressure (atmospheric pressure) in a space on the outside of the intermediate storage portion 161.

In a case where the liquid accommodating body 30 is detachable, the filling operation may be performed in a state where the liquid accommodating body 30 is not connected. In this case, the opening/closing valve provided in the upstream side liquid supply flow path 166 may be closed when the upstream side liquid supply flow path 166 is filled with liquid. Alternatively, the operation of filling the upstream side liquid supply flow path 166 with liquid may be performed in a state where an attachment is mounted instead of a main tank. As the attachment, a bag that is in a state of being filled with no liquid and an attachment that is obtained by attaching a gas-liquid separating film to an atmosphere communication portion.

The intermediate storage portion 161 may be omitted. For example, a tube that communicates with a liquid accommodating bag may be connected to the introduction needle portion 164 so that the upstream side liquid supply flow path 166 is filled with liquid flowing from the liquid accommodating bag.

The pressure adjustment mechanism 163 may be provided in the liquid ejecting head 36 instead of being provided in the intermediate storage body 145.

The user may manually press the pressing member 195 to pressurize the intermediate storage body 145 from the outside. In addition, the user may press the first diaphragm 184 of the intermediate storage body 145 with a hand.

The liquid accommodating body is not limited to an opened tank. For example, the liquid accommodating body may be an air-tightly closed liquid accommodating body that includes a bag filled with liquid and a pressurizing chamber that pressurizes the bag by using gas.

The liquid accommodating body may be an external liquid accommodating body that is disposed on the outside of the housing of the liquid ejecting apparatus. In this case, the liquid accommodating body may be attached to a side surface of the housing and may be disposed at a position separated from the housing with the liquid supply tube being interposed therebetween.

The liquid ejecting apparatus is not limited to a serial printer and may be a lateral printer in which a liquid ejecting unit ejects liquid on a medium while moving in two directions of a main scanning direction and a sub scanning direction. In addition, the liquid ejecting apparatus may be a line printer in which a liquid ejecting unit has a predetermined length so that the liquid ejecting unit can eject liquid on the entire region in a width direction of a target (for example, medium) and the liquid ejecting unit ejects liquid on a medium in the middle of transportation while the medium is being transported at a constant speed. In a case where the liquid ejecting apparatus is a line printer, an intermediate storage body connection portion to which an intermediate storage body can be connected may be provided on a surface (for example, upper surface) of a holding member holding a liquid ejecting unit, which is different from a liquid ejecting unit side surface, for example. Such an intermediate storage body connection portion is provided in the middle of a liquid supply flow path that connects a liquid accommodating body disposed in a housing of the liquid ejecting apparatus or on the outside of the housing and the liquid ejecting unit in the housing.

The liquid ejecting apparatus may not be included in a multifunction machine and may be a machine dedicated to printing.

The medium is not limited to a paper sheet and the medium may be a resin film, a resin sheet, a composite film of resin and metal (laminated film), woven fabric, non-woven fabric, metal foil, a metal film, a ceramic sheet, or the like.

The liquid ejecting apparatus is not limited to a liquid ejecting apparatus that performs printing on a flat medium such as a paper sheet and may be a liquid ejecting apparatus for forming a three-dimensional object that forms a three-dimensional object by ejecting resin liquid droplets with an ink jet system. In this case, the medium may be a mount which is a resin liquid droplet discharging target or a sheet-shaped substrate.

The entire disclosure of Japanese Patent Application No. 2016-163865, filed Aug. 24, 2016 and No. 2016-180255, filed Sep. 15, 2016 are expressly incorporated by reference herein.

What is claimed is:

1. A liquid accommodating body comprising:

a liquid accommodating chamber that accommodates a liquid;

a pouring port through which the liquid is poured into the liquid accommodating chamber;

a visual recognition portion through which a surface of the liquid accommodated in the liquid accommodating chamber is visually recognized and which is provided on a side wall forming the liquid accommodating chamber;

a partition wall that partitions the liquid accommodating chamber into a pouring port side liquid accommodating chamber into which the liquid is poured through the pouring port and a visual recognition portion side liquid accommodating chamber including the visual recognition portion in a direction intersecting a gravity direction;

a liquid communication portion which is provided between the partition wall and a bottom wall forming the liquid accommodating chamber and through which the pouring port side liquid accommodating chamber and the visual recognition portion side liquid accommodating chamber communicate with each other; and an upper communication portion extending through the partition wall at a position closer to the pouring port than the liquid communication portion in the gravity direction and through which the pouring port side liquid accommodating chamber and the visual recognition portion side liquid accommodating chamber communicate with each other.

2. The liquid accommodating body according to claim 1, wherein a liquid repellent treatment is performed on at least an inner wall of the visual recognition portion on the side wall of the liquid accommodating chamber, the inner wall being on the liquid accommodating chamber side.

3. The liquid accommodating body according to claim 1, further comprising:

an atmosphere communication portion through which at least the visual recognition portion side liquid accommodating chamber out of the visual recognition portion side liquid accommodating chamber and the pouring port side liquid accommodating chamber communicates with the atmosphere.

4. The liquid accommodating body according to claim 1, wherein the liquid communication portion is positioned closer to a gravity direction side than a falling region on the bottom wall in the pouring port side liquid accommodating chamber is, the falling region being a region onto which the liquid poured through the pouring port falls.

5. The liquid accommodating body according to claim 1, wherein the visual recognition portion is provided with a lower limit denoting portion that denotes a position which a liquid surface reaches when the amount of liquid accommodated in the liquid accommodating chamber reaches the lower limit, and wherein the liquid communication portion is positioned closer to a gravity direction side than the lower limit denoting portion is.

6. The liquid accommodating body according to claim 1, wherein the visual recognition portion is provided with an upper limit denoting portion that denotes a position which a liquid surface reaches when the amount of liquid accommodated in the liquid accommodating chamber reaches the upper limit.

7. A liquid ejecting apparatus comprising:

a liquid ejecting unit that ejects liquid through a nozzle; and the liquid accommodating body according to claim 1 that accommodates the liquid to be ejected by the liquid ejecting unit.

8. The liquid accommodating body according to claim 1, wherein, the bottom wall comprises a raised falling region that is raised in a counter-gravity direction from a remainder of the bottom wall and that at least partially overlaps the pouring port in the gravity direction during pouring of the liquid into the liquid accommodating chamber.

9. A liquid filling method of filling a liquid ejecting apparatus with liquid, the liquid ejecting apparatus including a liquid ejecting unit that ejects liquid and a liquid supply flow path that connects a liquid accommodating body and a liquid ejecting unit such that the liquid accommodated in the liquid accommodating body is supplied to the liquid ejecting unit and that includes an intermediate storage body connection portion that is positioned between the liquid accommodating body and the liquid ejecting unit and that is connected to an intermediate storage body including an intermediate storage portion in which the liquid is stored, the method comprising:

causing the liquid to flow from the intermediate storage body connection portion into an upstream side liquid supply flow path, which is a portion of the liquid supply flow path positioned on a side of the liquid accommodating body from the intermediate storage body connection portion, so that the upstream side liquid supply flow path is filled with the liquid.

10. The liquid filling method according to claim 9, further comprising:

connecting the intermediate storage body in which the intermediate storage portion is filled with the liquid in advance to the intermediate storage body connection portion so that the upstream side liquid supply flow path is filled with the liquid in the intermediate storage portion.

11. The liquid filling method according to claim 10, wherein the intermediate storage portion in the intermediate storage body is filled with the liquid in advance such that the pressure in the intermediate storage portion is higher than the pressure in a space on the outside of the intermediate storage portion.

12. The liquid filling method according to claim 9, further comprising:

causing the liquid to flow from the intermediate storage body connection portion into a downstream side liquid supply flow path, which is a portion of the liquid supply flow path positioned on a side of the liquid ejecting unit from the intermediate storage body connection portion, so that the downstream side liquid supply flow path is filled with the liquid.

13. The liquid filling method according to claim 9, wherein, the flow from the intermediate storage body connection portion into the upstream side liquid supply flow path is caused by applying an external force to the portion of the intermediate storage portion.

14. A liquid ejecting apparatus comprising:

a liquid ejecting unit that ejects liquid;

a liquid accommodating body that includes a liquid accommodating portion which accommodates the liquid, a pouring port through which the liquid is poured into the liquid accommodating portion from the outside, and an atmosphere communication hole through which the liquid accommodating portion communicates with the atmosphere;

a liquid supply flow path that connects the liquid accommodating body and the liquid ejecting unit such that the liquid accommodated in the liquid accommodating body is supplied to the liquid ejecting unit and that includes an intermediate storage body connection portion that is positioned between the liquid accommodating body and the liquid ejecting unit and that is connected to an intermediate storage body including an intermediate storage portion in which the liquid is stored; and a liquid flow mechanism that causes the liquid stored in the intermediate storage portion of the intermediate storage body connected to the intermediate storage body connection portion to flow into an upstream side liquid supply flow path which is a portion of the liquid supply flow path positioned on a side of the liquid accommodating body from the intermediate storage body connection portion.

15. The liquid ejecting apparatus according to claim 14, wherein, as the liquid flow mechanism, the intermediate storage body connection portion is provided above the upstream side liquid supply flow path in a gravity direction.

16. The liquid ejecting apparatus according to claim 14, wherein, as the liquid flow mechanism, a pressurizing mechanism that pressurizes the liquid in the intermediate storage portion of the intermediate storage body connected to the intermediate storage body connection portion is provided.

17. The liquid ejecting apparatus according to claim 14, wherein, as the liquid flow mechanism, a pressure reducing mechanism that reduces the pressure in the upstream side liquid supply flow path is provided.

18. The liquid ejecting apparatus according to claim 14, wherein, the liquid flow mechanism that causes the liquid stored in the intermediate storage portion of the intermediate storage body to flow into the upstream side liquid supply flow path by applying an external force to the portion of the intermediate storage portion.

19. The liquid ejecting apparatus according to claim 14, wherein, the intermediate storage body is detachably mounted to the intermediate storage body connection portion and the intermediate storage portion is filled with the liquid in advance.

* * * * *